US007866497B2

(12) United States Patent
Belden, Jr.

(10) Patent No.: US 7,866,497 B2
(45) Date of Patent: Jan. 11, 2011

(54) BOTTLE SECURITY DEVICE

(75) Inventor: Dennis D. Belden, Jr., Canton, OH (US)

(73) Assignee: Checkpoint Systems, Inc., Philadelphia, PA (US)

( * ) Notice: Subject to any disclaimer, the term of this patent is extended or adjusted under 35 U.S.C. 154(b) by 492 days.

(21) Appl. No.: 12/001,691

(22) Filed: Dec. 12, 2007

(65) Prior Publication Data

US 2009/0152230 A1 Jun. 18, 2009

(51) Int. Cl.
*B65D 51/00* (2006.01)
*B65D 41/00* (2006.01)

(52) U.S. Cl. ..... 215/223; 215/228; 215/316

(58) Field of Classification Search ..... 215/223, 215/222, 218, 217, 214, 213, 211, 228, 243, 215/244, 239, 238, 237, 235, 287, 288, 289, 215/283, 280, 277, 273, 364, 356, 355, 44, 215/43, 346, 341, 316, 303, 295, 200, 201, 215/219; 220/351, 354.4, 245.4, 348, 345.2, 220/345.1, 830, 827, 810, 812, 811, 212, 220/212.5, 254.5, 254.3, 254.1, 254.9, 254.8, 220/326, 325, 324, 315; 222/153.03, 153.01, 222/470, 559, 562, 563; D9/436, 435
See application file for complete search history.

(56) References Cited

U.S. PATENT DOCUMENTS 445,755 A 2/1891 King
654,533 A 7/1900 Garner
770,387 A 9/1904 Richards
783,885 A 2/1905 MoDougall
809,213 A 1/1906 Osgood
833,446 A 10/1906 Degener
880,723 A 3/1908 Cumming
1,343,962 A 6/1920 Byrne
1,937,295 A 11/1933 Rettenmeyer
2,418,039 A 3/1947 Mays
3,025,990 A 3/1962 Pancrazi
3,102,651 A * 9/1963 Boese ..... 215/43
3,837,518 A 9/1974 Gach
3,843,006 A 10/1974 Naito et al.
3,863,798 A 2/1975 Kurihara et al.
3,893,582 A 7/1975 Kowalik
3,913,769 A * 10/1975 Scrocco et al. ..... 215/206
3,944,102 A 3/1976 Grau
3,947,930 A 4/1976 Martens et al.

(Continued)

FOREIGN PATENT DOCUMENTS

AR 203305 8/1975

(Continued)

*Primary Examiner*—Anthony Stashick
*Assistant Examiner*—Robert J Hicks
(74) *Attorney, Agent, or Firm*—Sand & Sebolt

(57) ABSTRACT

A bottle security device locks onto a bottle neck to prevent theft of the bottle or its contents. The device includes a housing and a cap which receives a portion of the bottle neck and rotates relative to the housing. A spiraling cam surface provides a mechanism during rotation of the cap to move a securing member between a secured position to engage the bottle neck and an unsecured position to disengage from the bottle neck. A locking mechanism is provided to prevent rotation of the cap to keep the device locked on the bottle neck.

20 Claims, 14 Drawing Sheets

U.S. PATENT DOCUMENTS

| | | | | | |
|---|---|---|---|---|---|
| 3,950,917 | A | | 4/1976 | Chokai et al. | |
| 4,056,209 | A | | 11/1977 | Winkler et al. | |
| 4,260,067 | A | | 4/1981 | Andruchiw | |
| 4,279,353 | A | | 7/1981 | Honma | |
| 4,364,483 | A | * | 12/1982 | Golde | 215/218 |
| 4,570,810 | A | | 2/1986 | Hawkins | |
| 4,710,752 | A | | 12/1987 | Cordery | |
| 4,775,061 | A | | 10/1988 | Coote | |
| 4,796,768 | A | | 1/1989 | Stuckey | |
| 4,944,075 | A | | 7/1990 | Hogan | |
| 4,960,218 | A | * | 10/1990 | Toida et al. | 215/311 |
| 4,984,698 | A | | 1/1991 | Stuckey | |
| 5,085,332 | A | | 2/1992 | Gettig et al. | |
| 5,114,029 | A | | 5/1992 | Gibilisco | |
| 5,261,548 | A | * | 11/1993 | Barker et al. | 215/230 |
| 5,269,429 | A | | 12/1993 | Schumacher | |
| 5,303,835 | A | | 4/1994 | Haber et al. | |
| 5,386,924 | A | | 2/1995 | Finta et al. | |
| 5,431,293 | A | | 7/1995 | Piron | |
| 5,433,329 | A | | 7/1995 | Weinstein | |
| 5,462,186 | A | | 10/1995 | Ladina et al. | |
| 5,464,109 | A | | 11/1995 | Greenwald | |
| 5,519,381 | A | | 5/1996 | Marsh et al. | |
| 5,586,670 | A | | 12/1996 | Greenwald | |
| 5,602,530 | A | | 2/1997 | Holmgren | |
| 5,615,788 | A | | 4/1997 | Larguia | |
| 5,638,970 | A | | 6/1997 | Garby et al. | |
| 5,678,712 | A | | 10/1997 | Rios | |
| 5,732,836 | A | | 3/1998 | Barker et al. | |
| 5,749,484 | A | | 5/1998 | Trout | |
| 5,769,252 | A | | 6/1998 | Volpe | |
| 5,957,313 | A | | 9/1999 | Bouan | |
| 5,960,972 | A | | 10/1999 | Larguia, Sr. | |
| 6,382,416 | B1 | | 5/2002 | Gainey | |
| 6,604,643 | B1 | | 8/2003 | Michael et al. | |
| 6,631,629 | B1 | | 10/2003 | Fuss et al. | |
| 6,769,557 | B2 | | 8/2004 | Michael et al. | |
| 6,912,878 | B2 | | 7/2005 | Belden, Jr. | |
| 7,007,523 | B2 | | 3/2006 | Belden, Jr. | |
| 7,100,784 | B2 | | 9/2006 | Belden, Jr. | |
| 2003/0102279 | A1 | | 6/2003 | Michael et al. | |
| 2003/0121879 | A1 | * | 7/2003 | Smith et al. | 215/251 |
| 2003/0168456 | A1 | | 9/2003 | Tomasella | |
| 2004/0016269 | A1 | | 1/2004 | Skjellerup | |
| 2004/0040962 | A1 | * | 3/2004 | Bielecki et al. | 220/254.1 |
| 2004/0060892 | A1 | | 4/2004 | Heston et al. | |
| 2004/0182814 | A1 | | 9/2004 | Suffo | |
| 2006/0170559 | A1 | * | 8/2006 | Marsilio et al. | 340/572.9 |

FOREIGN PATENT DOCUMENTS

| | | |
|---|---|---|
| AR | 212291 | 6/1978 |
| AR | 214228 | 5/1979 |
| AR | 227988 | 12/1982 |
| AR | 235976 | 10/1987 |
| AR | 239915 | 12/1989 |
| AR | 246914 | 10/1994 |
| DE | 2121739 | 11/1972 |
| DE | 2307205 | 8/1974 |
| DE | 3211387 | 9/1983 |
| EP | 0385540 | 9/1990 |
| EP | 0522679 | 1/1993 |
| EP | 0687635 | 12/1995 |
| FR | 2586231 | 2/1987 |
| FR | 2608285 | 6/1988 |
| GB | 677311 | 8/1952 |
| GB | 2082552 | 3/1982 |
| WO | WO 89-07076 | 8/1989 |
| WO | WO 91/04201 | 4/1991 |
| WO | WO 92/00173 | 1/1992 |
| WO | WO 92/12067 | 7/1992 |
| WO | WO 94/08867 | 4/1994 |
| WO | WO 97/00819 | 1/1997 |
| WO | WO 99/67149 | 12/1999 |

* cited by examiner

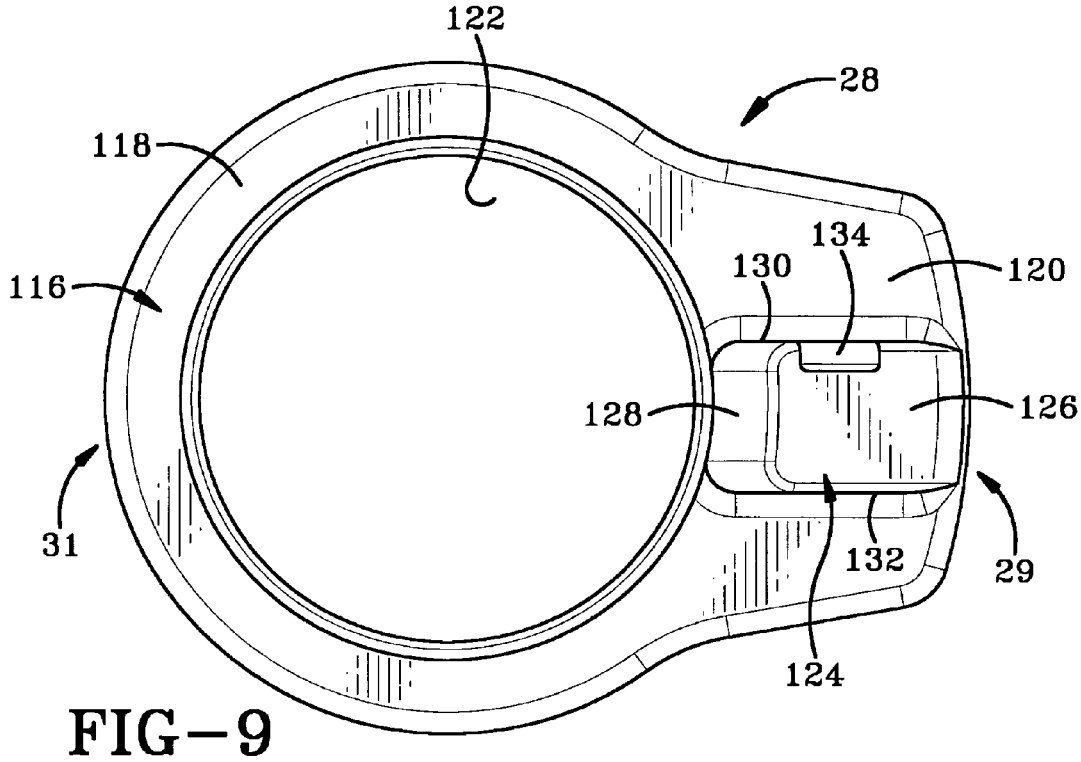
FIG-9
FIG-10
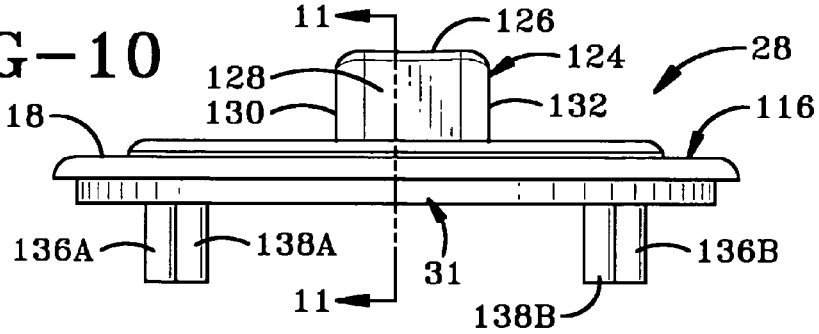
FIG-11
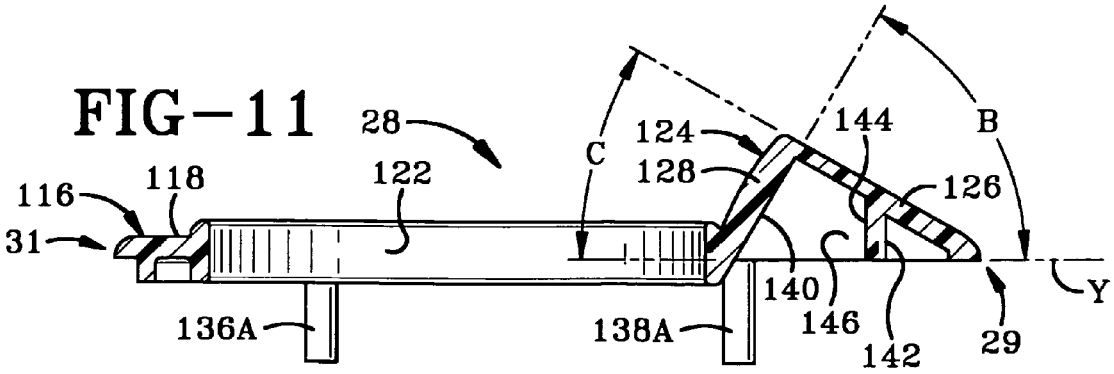

BOTTLE SECURITY DEVICE

BACKGROUND OF THE INVENTION

1. Technical Field

The present invention relates generally to security devices used in the prevention of theft. More particularly, the present invention relates to bottle security devices used in the prevention of theft of bottles and the contents thereof. Specifically, the present invention relates to a bottle security device which is secured to the neck of a bottle.

2. Background Information

It is well known in the field of merchandising that there is great need for the prevention of the theft of various items of merchandise. Many items of merchandise which are likely theft items are contained within bottles. These bottles typically have various types of caps or closures which a thief may remove so that the contents thereof may be stolen or consumed while the thief is inside the store. Thus, there is a need for bottle security devices which will provide an alarm upon an attempted removal of the bottle from the store as well as prevent the removal of the contents from the bottle. Amongst the various types of bottle security devices are those which have a threaded member which threadedly engages the bottle neck itself. Another category of bottle security devices utilize a strap which loops around and is tightly secured to the neck so that the security device cannot be easily removed. A third category of bottle security devices involves those which are neither threaded to the bottle directly or involve the use of a strap secured to the neck but rather have a cap with a cavity therein which slidably receives the top of the bottle neck and is secured thereto so that the security device prevents the removal of the contents from the bottle and also may not be removed from the bottle without a specially configured key absent breaking the bottle or defeating the security device. The present device falls in the third category and provides various improved security features.

BRIEF SUMMARY OF THE INVENTION

The present invention is to provides a bottle security device comprising: a housing; an interior chamber formed in the housing; a cap rotatable relative to the housing about a vertical axis; a portion of the cap in the interior chamber; a cavity formed in the cap adapted to receive therein a portion of a bottle neck; at least one securing member in the interior chamber; a first cam surface which spirals radially outwardly relative to the axis; a second cam surface; a sliding engagement between the first and second cam surfaces during rotation of the cap relative to the housing; a secured position of the at least one securing member adapted to engage the bottle neck; an unsecured position of the at least one securing member adapted to be disengaged from the bottle neck; and wherein the at least one securing member is movable in response to the sliding engagement from one of the secured and unsecured positions to the other of the secured and unsecured positions.

The present invention also provides a bottle security device comprising: a housing; an interior chamber formed in the housing; a cap rotatable relative to the housing about a vertical axis; a portion of the cap in the interior chamber; a cavity formed in the cap adapted to receive therein a portion of a bottle neck; at least one securing member in the interior chamber; a first cam surface which spirals radially outwardly relative to the axis; a second cam surface; a sliding engagement between the first and second cam surfaces during rotation of the cap relative to the housing; wherein one of the first and second cam surfaces is on the at least one securing member; the other of the first and second cam surfaces is on one of the cap and housing; and the at least one securing member is movable in response to rotation of the cap relative to the housing between a secured position adapted to engage the bottle neck and an unsecured position adapted to be disengaged from the bottle neck.

BRIEF DESCRIPTION OF THE SEVERAL VIEWS OF THE DRAWINGS

FIG. 9 is a top plan view of the housing top member.

FIG. 10 is a rear elevational view of the housing top member.

FIG. 11 is a sectional view taken on line 11-11 of FIG. 10.

Similar numbers refer to similar parts throughout the drawings.

DETAILED DESCRIPTION OF THE INVENTION

Figure 1:
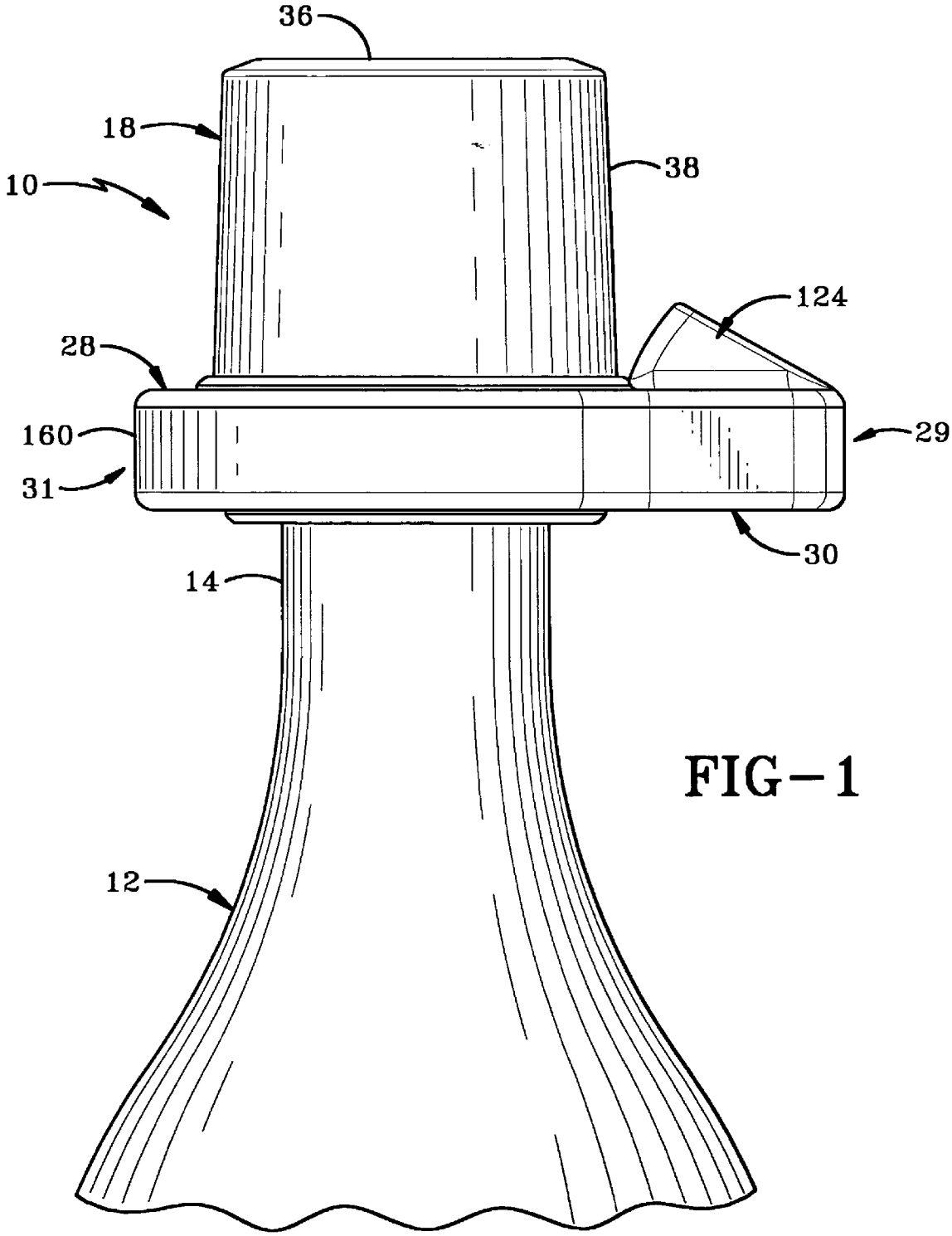
FIG. 1 is a side elevational view of the bottle security device of the present invention secured to a bottle neck.
Figure 2:
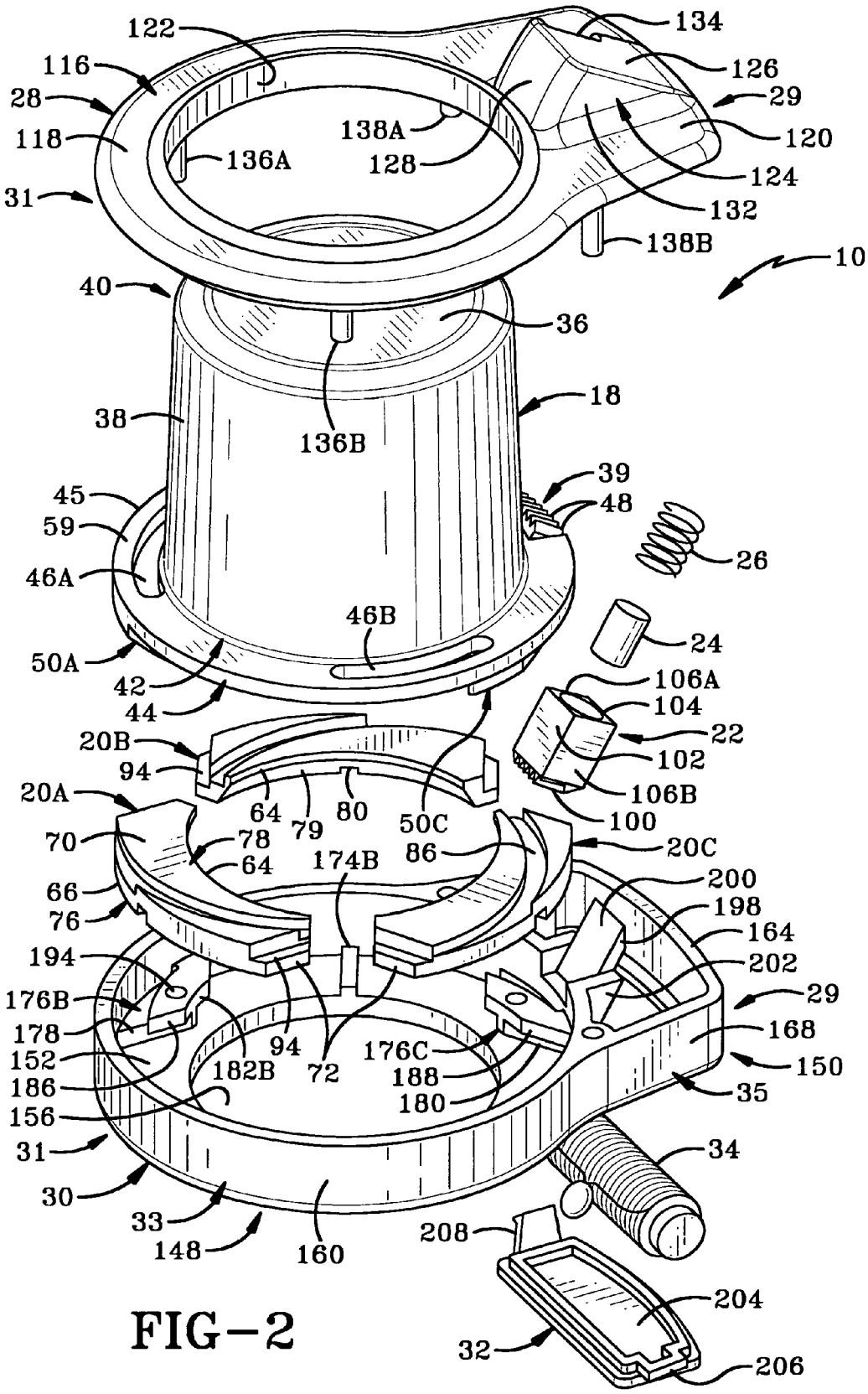
FIG. 2 is an exploded perspective view of the bottle security device.
Figure 3:
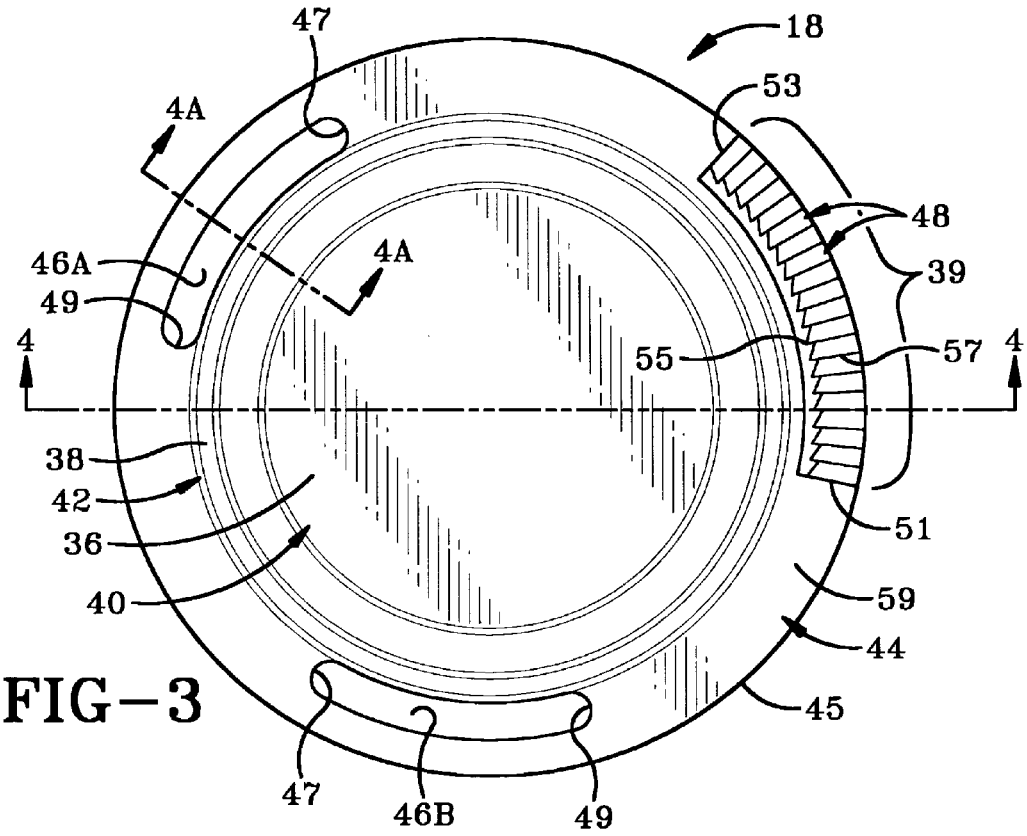
FIG. 3 is a top plan view of the cap.

The bottle security device of the present invention is shown generally at 10 in FIG. 1. Device 10 is shown in FIG. 1 mounted on a bottle 12 having a neck 14 which includes a radially outwardly extending annular flange 16 (FIG. 14) having a downwardly facing lower surface 17. Device 10 is securable to bottle neck 14 to prevent the theft of bottle 12 and its contents absent the use of a special key or damage to device 10 or bottle 12. Referring to FIG. 2, device 10 includes a cap 18, three securing members 20A-C, a locking member 22, a magnetically attractable cylinder 24, a coil spring 26, a housing top member 28 and a housing bottom member 30 which is secured to top member 28 when assembled to provide a housing having a front 29 and rear 31. The housing further includes a bottom wall section 32 which is securable to bottom member 30. The housing includes a circular portion 33 and a generally rectangular portion 35 extending radially outwardly from circular portion 33 in a forward direction. An electronic article surveillance (EAS) tag 34 is mounted within the housing for activating an alarm upon unauthorized removal of device 10 and bottle 12 from a secured area such as a store or the like. Each of elements 18, 20, 22, 28, 30 and 32 are formed of rigid materials, typically a rigid plastic.

Figure 4:
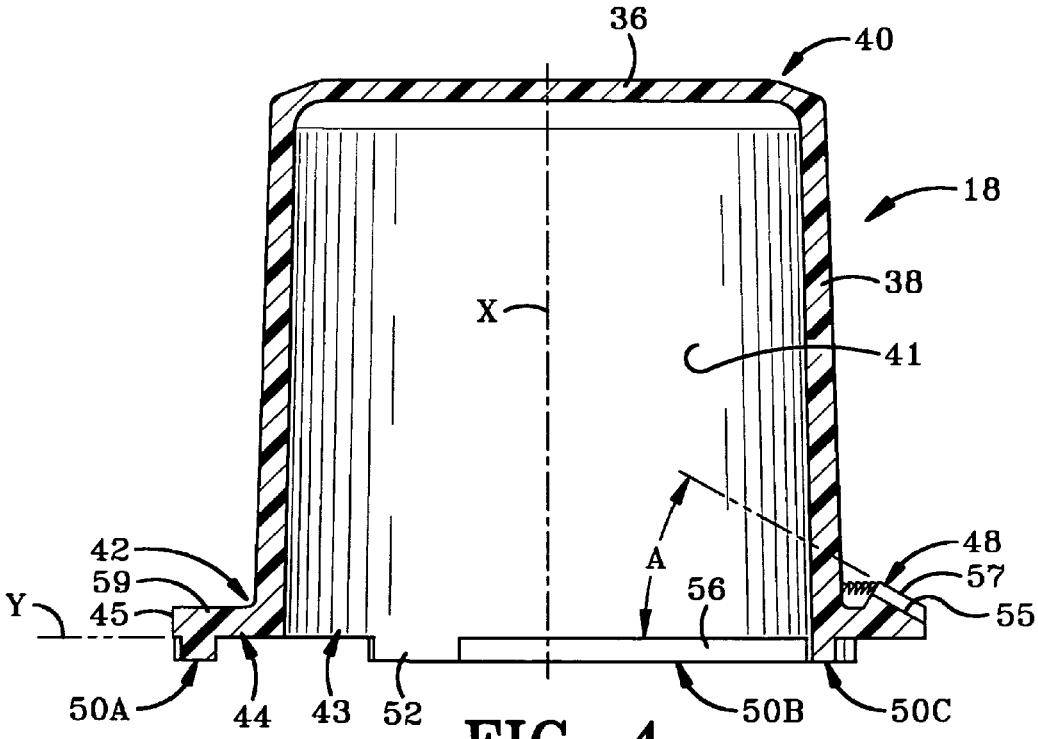
FIG. 4 is a sectional view taken on line 4-4 of FIG. 3.
Figure 4A:
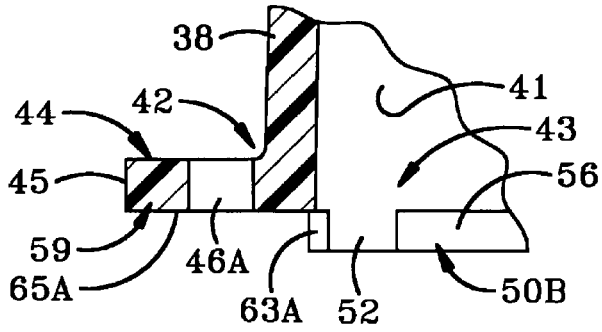
FIG. 4A is a sectional view taken on line 4A-4A of FIG. 3.

Referring to FIGS. 2-5, cap 18 is described in further detail. Cap 18 includes a substantially flat circular top wall 36 and an annular sidewall 38 connected to top wall 36 and extending downwardly therefrom. However, cap 18 may have an open cap configuration in which top wall 36 is eliminated or partially eliminated and sidewall 38 may be substantially shorter than shown in the figures. Sidewall 38 is substantially cylindrical or tapers slightly to have a frustoconical configuration. Sidewall 38 has an upper end 40 and a lower end 42 and defines therewithin a cavity 41 (FIG. 4) having an entrance opening 43 adjacent lower end 42 whereby bottle neck 14 may be inserted through entrance opening 43 into cavity 41. An annular flange 44 is connected to and extends radially outwardly from sidewall 38 adjacent lower end 42 to a circular outer perimeter 45. Sidewall 38 and flange 44 are concentric about a vertically extending axis X (FIGS. 4-5) passing through the center of top wall 36 and cavity 41. A pair of arcuate slots 46A and B are formed in flange 44 extending from the top to the bottom thereof and having respective first and second circumferentially opposed ends 47 and 49. Each slot 46 is concentric about axis X and defines a circumferential width between first and second ends 47 and 49 which is approximately 60 degrees. The portion of flange 44 between first end 47 of slot 46B and second end 49 of slot 46A also has a circumferential width of approximately 60 degrees. A section 39 comprising a series of one-way locking teeth 48 is formed atop flange 44 so that teeth 48 extend generally upwardly and are angled radially outwardly. Section 39 of locking teeth 48 has first and second circumferentially opposed ends 51 and 53 defining therebetween a circumferential width which is approximately 60 degrees in the exemplary embodiment although this may vary. The segment of flange 44 extending between first end 51 of section 39 and second end 49 of slot 46B has a circumferential width of approximately 60 degrees. Likewise, the segment of flange 44 extending circumferentially between second end 53 of section 39 and first end 47 of slot 46A has a circumferential width of approximately 60 degrees. Thus, slots 46A and section of teeth 48 are substantially evenly spaced from one another circumferentially about flange 44. As shown in FIG. 4, each tooth 48 has a base 55 and a tip 57 each of which is straight and defines a line defining an angle A with respect to a horizontal plane Y wherein angle A in the exemplary embodiment is approximately 30 degrees and typically in the range of 20 to 70 degrees, more typically from 25 to 60 degrees and usually from 30 to 45 degrees. Tip 57 thus is angled from adjacent outer perimeter 45 of flange 44 upwardly and radially inwardly toward axis X. However, angle A may vary from 0 to 90 degrees or any other suitable angle.

Figure 5:
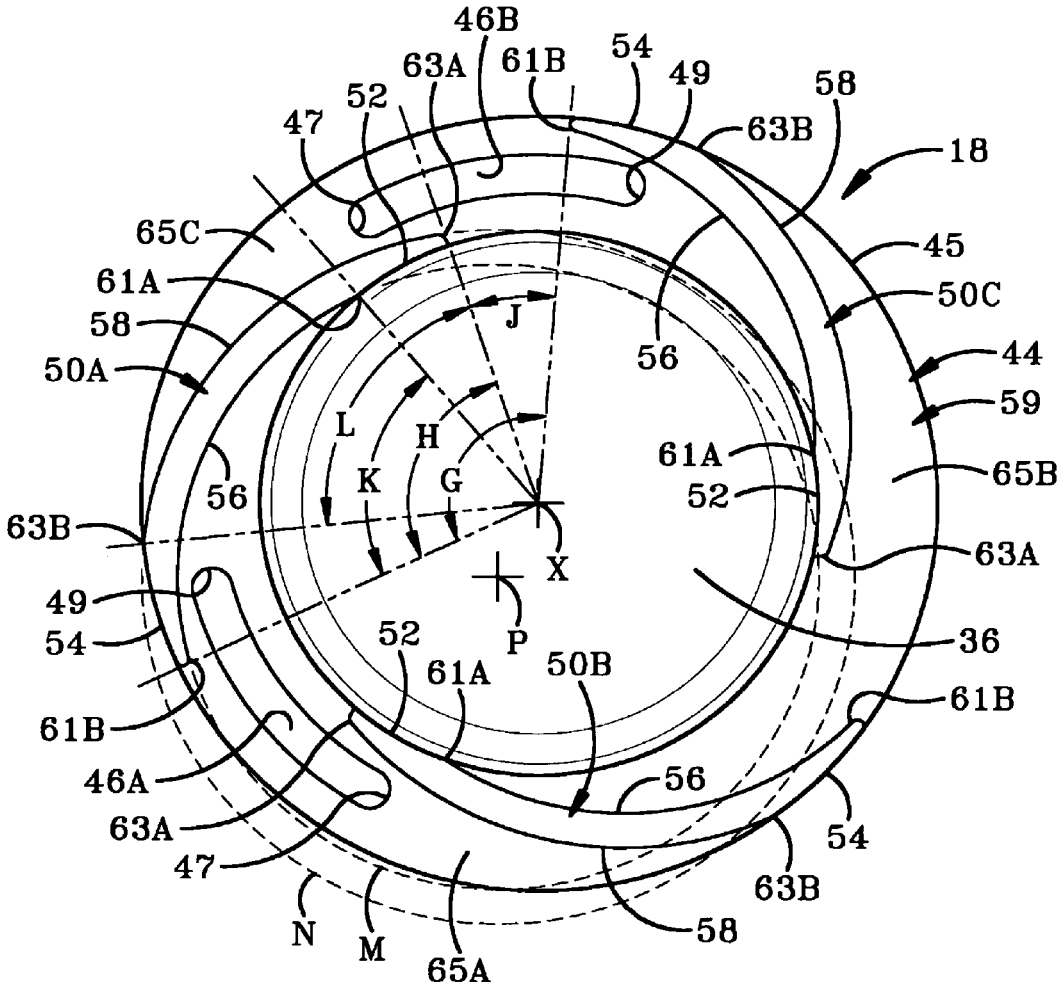
FIG. 5 is a bottom plan view of the cap.

Referring to FIG. 5, flange 44 includes three arcuate projections or ridges 50A-C which extend downwardly from a flat annular wall 59 of flange 44. Each ridge 50 has an inner end 52 along an inner perimeter of flange 44 adjacent sidewall 38 and an outer end 54 adjacent and in communication with outer perimeter 45 of flange 44. Each ridge 50 spirals radially outwardly with respect to axis X from first end 52 to second end 54. Slot 46A is disposed between ridges 50A and 50B extending from adjacent and radially outwardly of inner end 52 of ridge 50B to adjacent and radially inwardly of outer end 54 of ridge 50A. Likewise, slot 46B is disposed between ridges 50B and 50C extending from adjacent and radially outwardly of inner end 52 of ridge 50A to adjacent and radially inwardly of outer end 54 of ridge 50C. Each ridge 50 has a first inner cam surface 56 which faces generally radially inwardly and spirals outwardly with respect to axis X from first end 52 to second end 54. Likewise, each ridge 50 has a second outer cam surface 58 which faces generally radially outwardly and spirals outwardly with respect to axis X from first end 52 to second end 54.

With continued reference to FIG. 5, each inner cam surface 56 has inner and outer terminal ends 61A and 61 B respectively at inner and outer ends 52 and 54 of ridge 50. Likewise, each outer cam surface 58 has inner and outer terminal ends 63A and 63B respectively at inner and outer ends 52 and 54. The inner terminal ends 61 B of one of the ridges such as ridge 50A and another adjacent ridge such as ridge 50C define therebetween a circumferential width or distance G which in the exemplary embodiment is approximately 120 degrees. Each ridge 50 extends circumferentially a distance H or has a circumferential width or distance H defined between inner terminal end 63A of outer cam surface 58 and outer terminal end 61B of inner cam surface 56 of a given ridge 50. Circumferential distance H in the exemplary embodiment is approximately 95 to 100 degrees. Thus, the difference between angle G and angle H is angle J or circumferential distance J defined between an outer terminal end 61B of an inner cam surface 56 of one ridge and the adjacent inner terminal end 63A of an outer cam surface 58 of the closest adjacent ridge 50, as shown with reference to ridges 50C and 50A. Distance J is thus in the exemplary embodiment approximately 20 to 25 degrees. Each inner cam surface 56 has a circumferential distance K defined between the inner and outer terminal ends 61A and 61B thereof. Distance K in the exemplary embodiment is approximately 65 to 75 degrees. Likewise, outer cam surface 58 has a circumferential distance L defined between the inner and outer terminal ends 63A and 63B thereof. In the exemplary embodiment, distance L is approximately 70 to 80 degrees. In the exemplary embodiment, each inner cam surface 56 is an arc of a circle M which is shown in dashed lines in FIG. 5 and is concentric about a vertical axis P adjacent and parallel to vertical axis X. Axis P passes through top wall 36 of cap 18 and also through cavity 41. Similarly, each outer cam surface 58 is an arc of a circle N which has a greater diameter than circle M and is also concentric about axis P. Flat annular wall 59 has a flat horizontal lower surface including three crescent-shaped flat lower surfaces 65A-C respectively between each adjacent pair of ridges 50. Each of these downwardly facing crescent-shaped surfaces 65 extends circumferentially from an inner cam surface 56 of one ridge 50 to an outer cam surface 58 of an adjacent ridge 50 and radially from the inner perimeter of flange 44 to outer perimeter 45. Slots 46A and 46B are respectively within two of these crescent-shaped regions so that slot 46A extends from the top of flange 44 to crescent-shaped surface 65A and slot 46B extends from the top of flange 44 to crescent-shaped surface 65C.

Figure 6:
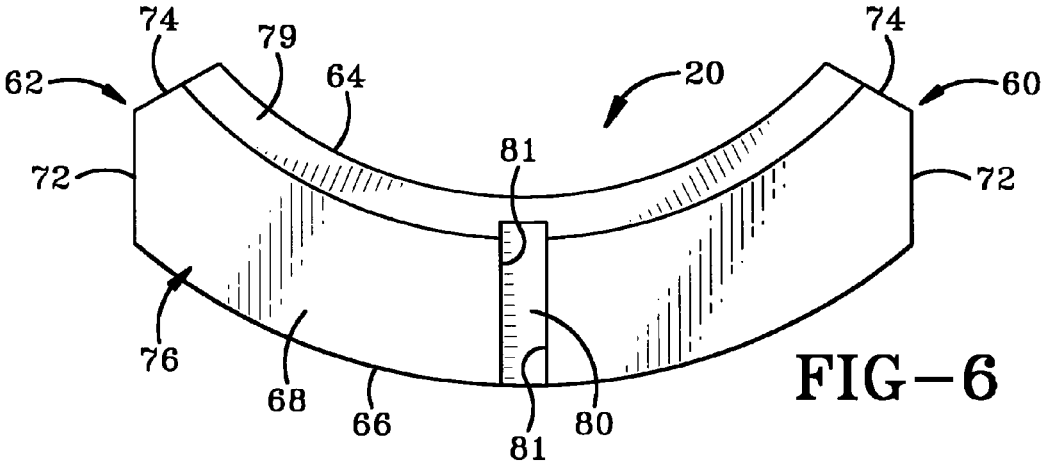
FIG. 6 is a bottom plan view of one of the securing members.
Figure 7:
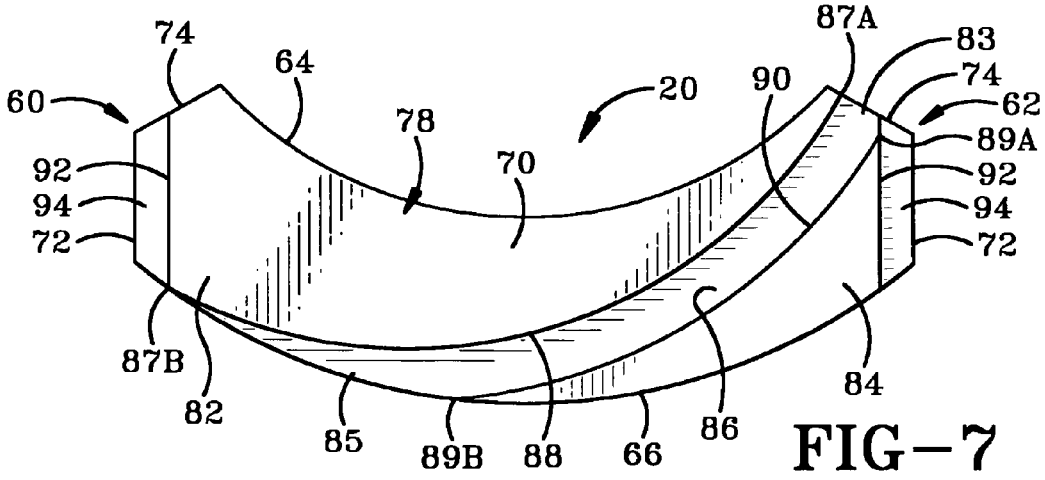
FIG. 7 is a top plan view of one of the securing members.
Figure 17:
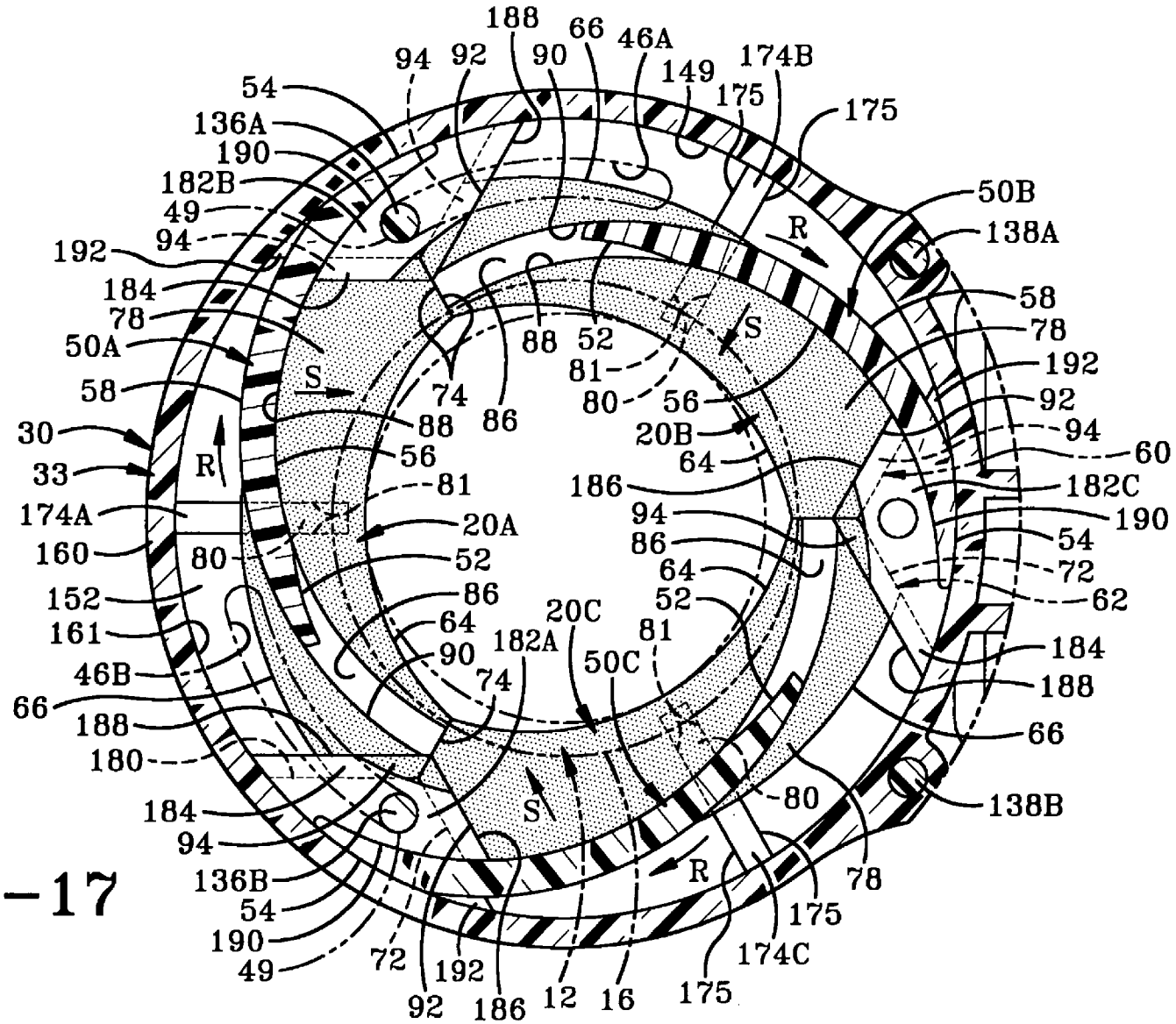
FIG. 17 is a sectional view taken on line 17-17 of FIG. 16. with the rectangular portion of the housing substantially omitted and the securing members shaded for clarity.

Referring to FIGS. 6-7, securing members 20 are further described. It is noted that while three securing members 20 are shown in the exemplary embodiment, device 10 may be formed with a single securing member such as member 20. Each securing member 20 has a first and second circumferentially opposed ends 60 and 62, a convexly curved inner perimeter 64 extending from first end 60 to 62 and a convexly curved outer perimeter 66 extending from first end 60 to second end 62. Inner and outer perimeters 64 and 66 define arcs of respective circles which are substantially concentric about axis X when device 10 is assembled and members 20 are in the secured position (FIG. 17). Securing member 20 has parallel bottom and top surfaces 68 and 70 which are substantially flat and horizontal. Each end 60 and 62 has a lower laterally-facing guide surface 72 and a laterally facing abutment surface 74. The lower guide surfaces 72 on each end 60 and 62 are parallel to one another. The abutment surfaces 74 on each end 60 and 62 are approximately parallel to a radius of a circle which is concentric about axis X when device 10 is assembled and lie on such a radius in the secured position (FIG. 17). Each securing member 20 moves radially inwardly and outwardly as further described below so that when each securing member 20 is moved fully radially inwardly, the abutment surfaces 74 on first end 60 of one securing member 20 abuts the abutment surface 74 on a second end 62 of another securing member 20. Each securing member 20 includes a flat lower plate or wall 76 which defines bottom surface 68. A substantially flat upper plate or wall 78 is connected to and extends upwardly from lower plate 76 and is substantially parallel thereto. Each member 20 has a tapered surface 79 which tapers radially upwardly and inwardly along inner perimeter 64 along lower and upper plates 76 and 78. A straight groove 80 bounded by parallel guide surfaces 81 is formed in lower plate 76 extending upwardly from bottom surface 68 parallel to guide surfaces 72 and aligned on a radius of a circle concentric about axis X when device 10 is assembled. Securing member 20 may be formed without a groove 80 and corresponding guide surfaces or may be formed with additional grooves to provide additional guide surfaces if desired.

Referring to FIG. 7, each upper plate 78 includes an inner arm 82 which extends along the full length of inner perimeter 64 and an outer arm 84 which extends along about half of outer perimeter 66. Inner arm 82 is a generally arcuate triangular shape and is wider adjacent first end 60 and narrows to substantially a point adjacent second end 62 adjacent inner perimeter 64. Arm 84 is also a curved triangular shape and is wider adjacent end 62 and narrows to a point adjacent the midpoint between first and second ends 60 and 62 at outer perimeter 66. An arcuate groove 86 is formed in upper plate 78 between inner and outer arms 82 and 84 extending downwardly from top surface 70 and defining an arc of a circle. Each groove 86 spirals radially outwardly with respect to axis X from an inner terminal end 83 at abutment surface 74 of second end 62 adjacent inner perimeter 64 to an outer terminal end 85 adjacent first end 60 where it communicates with outer perimeter 66. An inner cam surface 88 on first arm 82 faces generally radially outwardly and bounds arcuate groove 86 so that it spirals radially outwardly in the same fashion. Inner cam surface 88 has an inner terminal end 87A at abutment surface 74 of second end 62 and an outer terminal end 87B at outer perimeter 66 adjacent first end 60. An outer cam surface 90 faces generally radially inwardly and bounds the other side of groove 86 and thus spirals radially outwardly in the same manner to adjacent the midpoint between ends 60 and 62. Outer cam surface 90 has an inner terminal end 89A at second end 62 and an outer terminal end 89B at outer perimeter 66 near the midpoint between first and second ends 60 and 62 and slightly closer to first end 60. Each groove 86 has a constant width and thus the cam surfaces 88 and 90 bounding a given groove 86 curve in a parallel fashion. Each groove 86 is configured to receive one of arcuate ridges 50 of flange 44 so that inner cam surface 56 of a respective ridge 50 slidably engages inner cam surface 88, and outer cam surface 58 of each ridge 50 slidably engages outer cam surface 90 during rotation of cap 18 relative to the housing. Each ridge 50 has a constant width and thus cam surface 56 and 58 bounding a given ridge 50 curve in parallel fashion. Inner and outer cam surfaces 56 and 58 curve in a mating fashion respectively with inner and outer cam surfaces 88 and 90. It is noted that securing member 20 may be formed with more than one groove similar to groove 86 to provide additional corresponding spiraling cam surfaces. In keeping with this option, additional projections or spiraling ridges similar to ridges 50 may be formed on flange 44 of cap 18 to provide additional cam surfaces received in these additional grooves. A pair of upper guide surfaces 92 which are parallel to one another are formed respectively on arms 82 and 84 adjacent first and second ends 60 and 62 and extend upwardly vertically from a respective pair of tabs 94 at ends 60 and 62. Each securing member thus steps horizontally inwardly along an upper surface of tab 94 from lower guide surface 72 to upper guide surface 92, which is parallel to surface 72.

Figure 8:
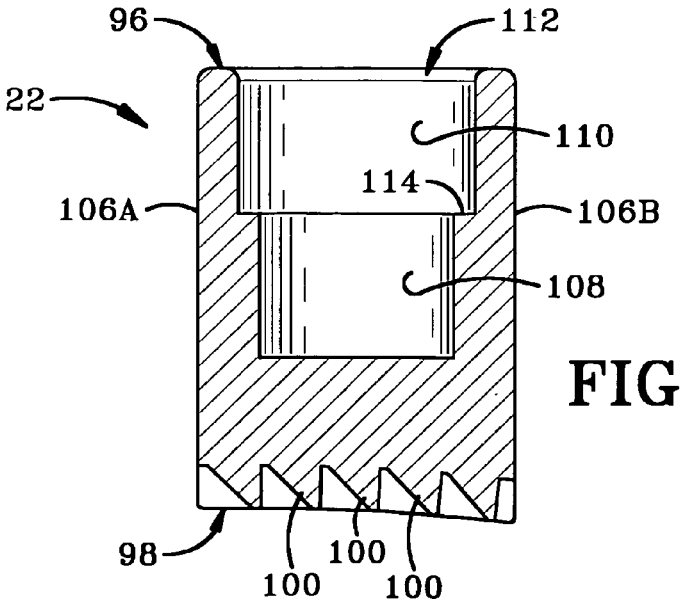
FIG. 8 is a sectional view of the locking member showing the teeth and the interior chamber.

Referring to FIG. 8, locking member 22 has upper and lower opposed ends 96 and 98 with a plurality of one-way locking teeth 100 formed at lower end 98 and extending downwardly therefrom for lockably engaging locking teeth 48 on flange 44. Locking teeth 100 and locking teeth 48 thus lockably engage one another to prevent rotation of cap 18 relative to the housing in one direction while allowing rotation in the opposite direction. Locking member 22 is substantially rectangular as viewed from the side and substantially square as viewed from above and has a generally parallelepiped configuration. Member 22 has a substantially flat inner side 102 (FIG. 2), a substantially flat outer side 104 opposed thereto and a pair of opposed flat lateral sides 106A and B. An interior chamber is formed in locking member 22 including a lower chamber 108 and an upper chamber 110 which has a greater diameter than that of lower chamber 108. The interior chamber has an entrance opening 112 and an annular lip 114 is formed between lower and upper chambers 110. Lower chamber 108 is configured for receiving cylinder 24 and upper chamber 110 is configured to receive spring 26 with a lower end of spring 26 abutting annular lip 114 for biasing locking member 22 to its locked position (FIG. 16) with locking teeth 100 lockably engaging teeth 48.

Figure 15:
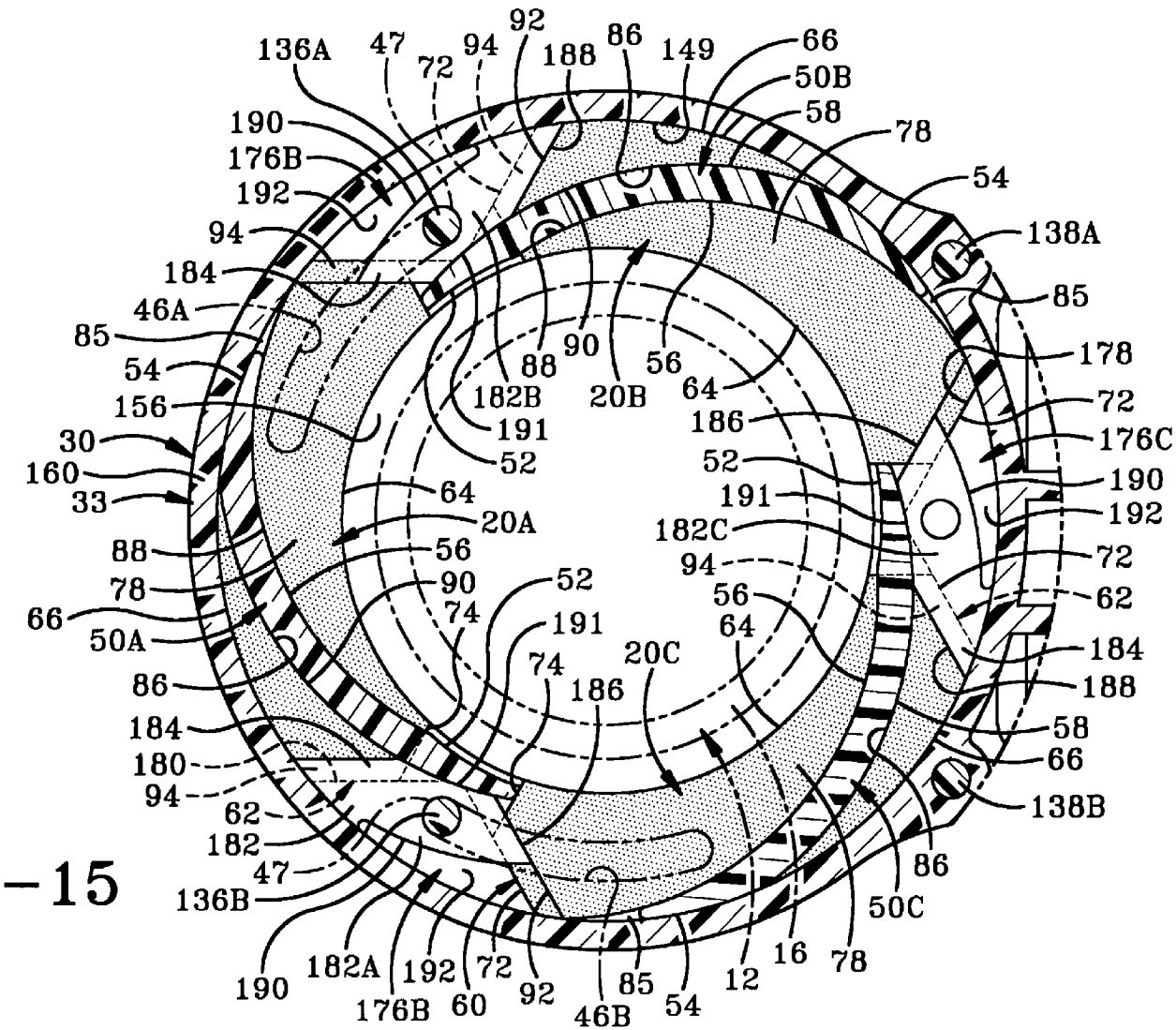
FIG. 15 is a sectional view taken on line 15-15 of FIG. 14. with the rectangular portion of the housing substantially omitted and the securing members shaded for clarity.

Referring to FIGS. 9-11, housing top member 28 is described in further detail. Member 28 includes a main wall 116 which has a circular wall portion 118 and a generally rectangular wall portion 120 extending radially outwardly therefrom. Circular wall portion 118 is concentric about axis X and defines a circular hole or upper entrance opening 122 extending from the top to the bottom of main wall 116. A wedge shaped portion 124 is connected to and extends upwardly from rectangular wall portion 120. Portion 124 includes a front wall 126 which tapers radially upwardly and inwardly toward axis X to a rear wall 128 which tapers radially downwardly and inwardly therefrom toward axis X to main wall 116 at a location adjacent hole 122. Portion 124 further includes first and second space sidewalls 130 and 132 which are generally triangular and connected to each of front and rear walls 126 and 128 and extend upwardly from main wall 116 of rectangular portion 120. A key alignment notch or indentation 134 is formed in wedge shaped portion 124 extending laterally inwardly from first sidewall 130. Referring to FIG. 10, a pair of rear support posts 136A and B are connected to and extend downwardly from circular wall portion 118 and are spaced from one another to extend respectively through slots 46A and 46B of flange 44 when device 10 is assembled (FIG. 15). Support posts 136A and B provide additional strength between the top and bottom housing members but may be eliminated without otherwise altering the function of device 10. Thus, flange 44 may be formed without slots 46 for receiving such posts therethrough. A pair of front support posts 138A and B likewise extend downwardly from rectangular wall portion 120 on opposite sides of wedge shaped portion 124. Referring to FIG. 11, rear wall of wedge shaped portion 124 has a flat inner surface 140 which is straight and tapers radially upwardly and outwardly away from axis X when device 10 is assembled at an angle B relative to horizontal plane Y wherein angle B is in the exemplary embodiment approximately 60 degrees, typically in the range of 20 to 70 degrees, more typically from 30 to 65 degrees and usually from 45 to 60 degrees. However, while the noted angles provide advantages discussed further below, angle B may be any suitable angle. An interior wall 142 is connected to and extends downwardly from front wall 126 and is spaced forward from rear wall 128. Interior wall 142 has a rear upwardly extending surface 144 which is substantially vertical. Front wall 126 angles radially inwardly and upwardly to define an angle C with horizontal plane Y which is in the exemplary embodiment about 30 degrees and thus at a right angle to surface 140. Angle C is the same as angle A and falls within the ranges noted with reference to angle A. A downwardly opening cavity 146 is formed in wedge shaped portion 124 and bounded by the inner surface of front wall 126 and surfaces 140 and 144.

Figure 12:
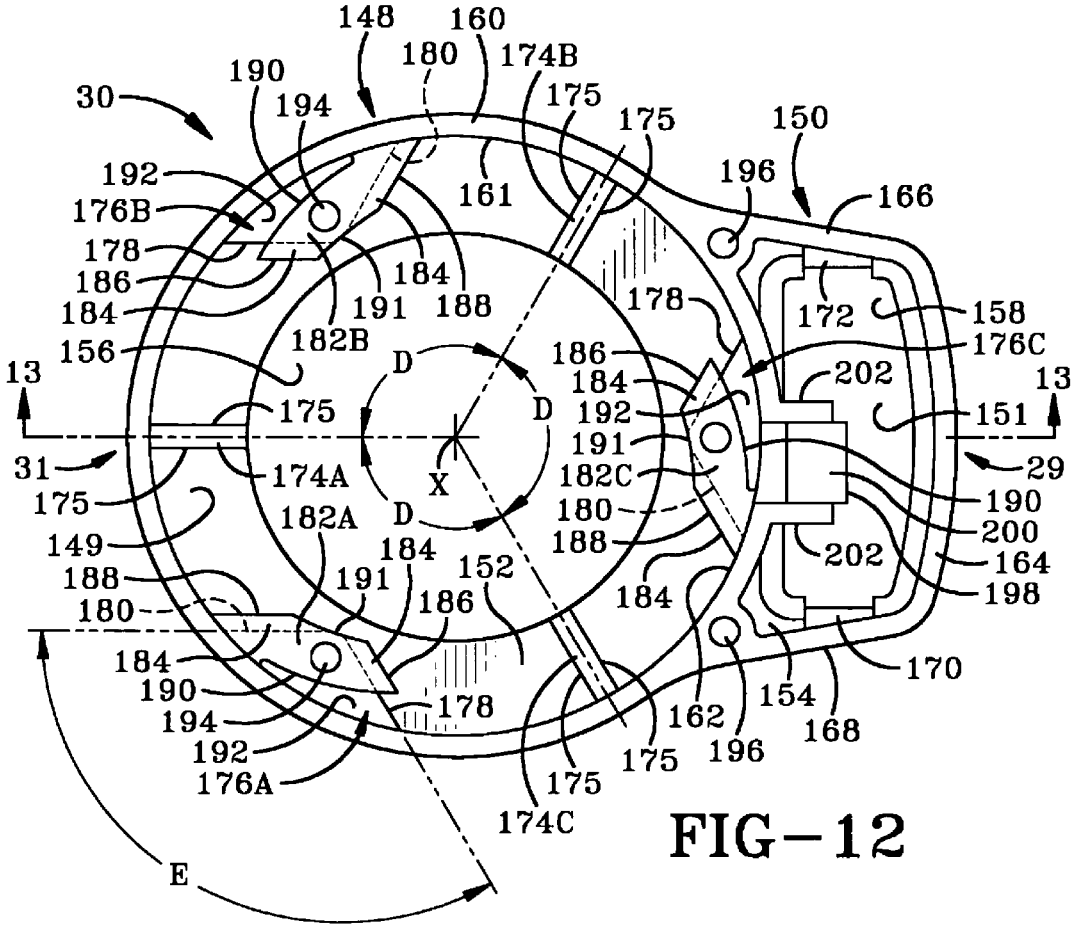
FIG. 12 is a top plan view of the housing bottom member.
Figure 13:
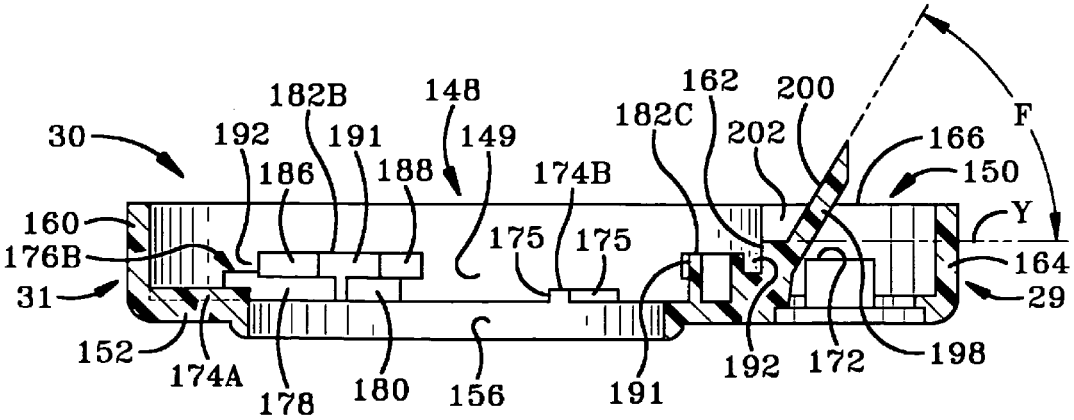
FIG. 13 is a sectional view taken on line 13-13 of FIG. 12.
Figure 14:
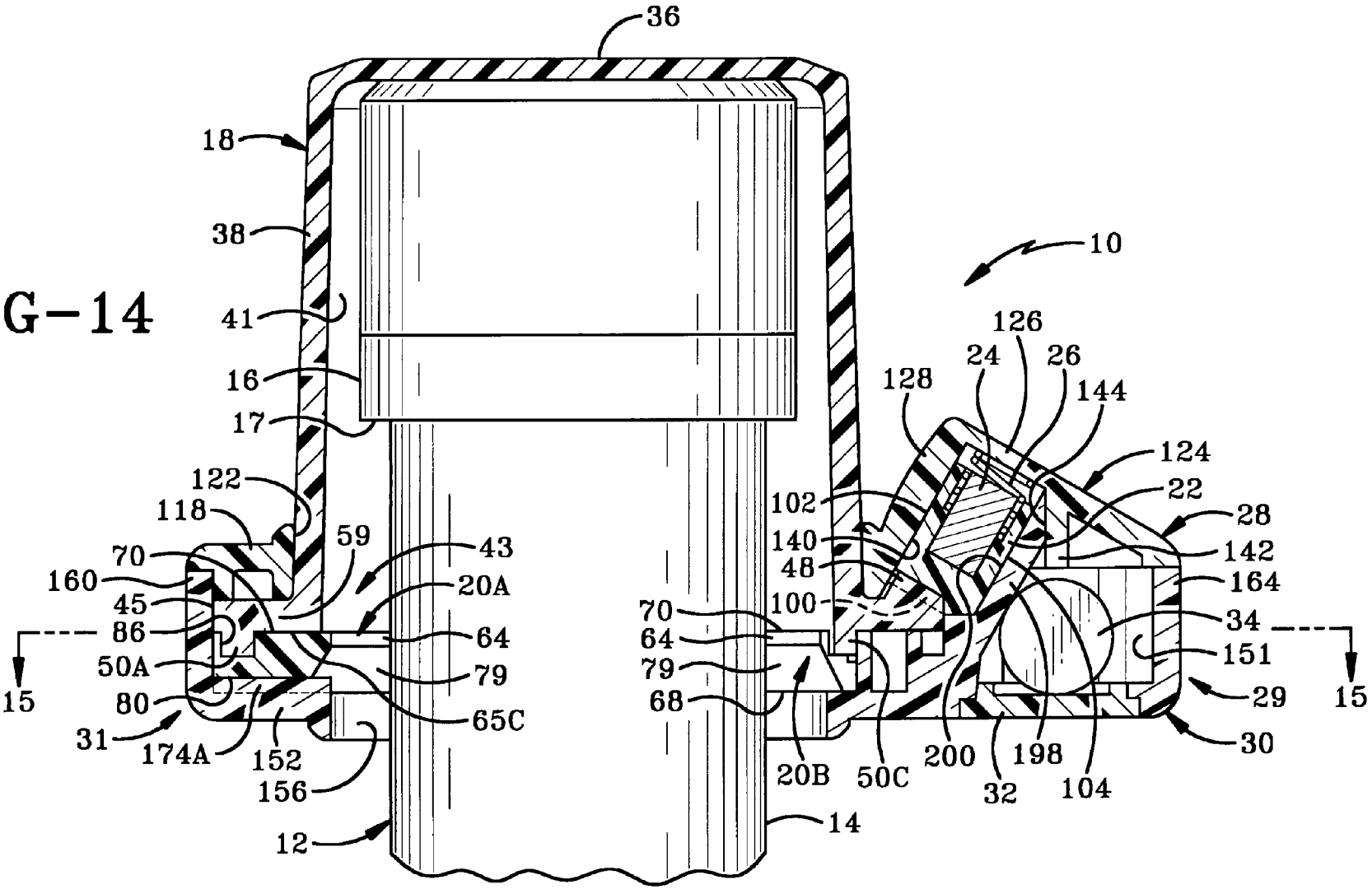
FIG. 14 is sectional view of the bottle security device on the bottle neck in the unsecured position.

Referring to FIGS. 12-13, bottom housing member 30 is described in greater detail. Bottom member 30 includes a circular portion 148 defining a circular interior chamber 149 and a generally rectangular portion 150 defining a generally rectangular interior chamber 151. Member 30 includes a bottom wall which includes a circular bottom wall portion 152 and a front bottom wall portion 154 extending radially forward from portion 152. A circular hole or lower entrance opening 156 is formed in circular bottom wall portion 152 and communicates with interior chamber 149, as does entrance opening 122 of housing top member 28 when device 10 is assembled. A substantially rectangular hole 158 is formed in the bottom of rectangular portion 150 which receives bottom wall section 32 (FIG. 2) when secured thereto (FIG. 14). Circular portion 148 includes a circular sidewall 160 having a circular inner surface 161 bounding and circumscribing interior chamber 149. Sidewall 160 includes an interior segment or arc 162 the outer surface of which bounds rectangular interior chamber 151. Rectangular portion 150 includes a front wall 164 and first and second lateral sidewalls 166 and 168 connected to front wall 164 and circular sidewall 160 with interior segment 162 extending therebetween. Ledges 170 and 172 are formed on rectangular portion 150 respectively along sidewalls 166 and 168.

Three straight ridges 174A-C (FIG. 12) having parallel guide surfaces 175 are connected to and extend upwardly from bottom wall portion 152, extend radially inwardly from sidewall 160 to the inner perimeter of bottom wall 152 which bounds hole 156 and are elongated horizontally along a radius of a circle which is concentric about axis X. Ridges 174 are circumferentially equally spaced from one another so that each adjacent pair of ridges 174 defines therebetween an angle D which is approximately 120 degrees. Three triangular guides 176A-C are connected to and extend upwardly from bottom wall 152 and radially inwardly from sidewall 160. Guides 176 are equally spaced from one another circumferentially with each of guides 176 positioned midway between an adjacent pair of ridges 174. Each guide 176 is a substantially flat horizontal plate having first and second straight lower guide surfaces 178 and 180 which are connected to and extend inwardly from sidewall 160 toward one another to terminate adjacent the inner perimeter of bottom wall 152 which bounds hole 156. Guide surfaces 178 and 180 of each guide 176 define therebetween an angle E which in the exemplary embodiment is approximately 120 degrees. The guide surface 178 of each guide 176 is parallel to the guide surface 180 of an adjacent guide 176 and also parallel to surfaces 175 of the straight guide 174 disposed between said surfaces 178 and 180. These parallel surfaces 178 and 180 of the respective guides 176 define therebetween a channel in which the respective securing member 20 is slidably received.

Three arms 182A-C (FIG. 12) are connected to sidewall 160 and extend radially inwardly therefrom and respectively over guides 176A-C. Each arm 182 is also a substantially flat horizontal plate seated on a respective guide 176 and includes a pair of overhangs 184 which extend outwardly over and beyond guide surfaces 178 and 180 of guide 176. First and second straight upper guide surfaces 186 and 188 are formed on a respective overhangs 184 parallel to and respectively adjacent guide surfaces 178 and 180. Second guide surface 188 is connected to and extends inwardly from sidewall 160. However, first guide surface 186 is on a free end of arm 182 which is spaced radially inwardly from inner surface 161 of sidewall 160. An arcuate outer surface 190 on each arm 182 faces generally radially outwardly and spirals radially inwardly relative to axis X from adjacent inner surface 161 of sidewall 160 to guide surface 186 at the free end of arm 182. Outer surface 190 and inner surface 161 of sidewall 160 thus define therebetween a curved triangular groove 192 bounded by the upper surface of a respective guide 176. An arcuate inner surface 191 on each arm 182 faces generally radially inwardly and spirals radially inwardly relative to axis X from guide surface 188 to guide surface 186 with a parallel curvature to outer surface 190. A rear post-receiving hole 194 is formed in each of arms 182A and 182B extending downwardly from the upper surfaces thereof for respectively receiving therein the lower ends of support posts 136A and 136B of top member 28 when device 10 is assembled (FIG. 15). A pair of front post-receiving holes 196 are spaced from one another adjacent and external to interior segment 162 of sidewall 160 respectively inwardly of and adjacent lateral sidewalls 166 and 168 for respectively receiving the lower ends of support posts 138A and 138B when device 10 is assembled.

A substantially flat tapered guide wall 198 (FIGS. 12-13) is connected to interior segment 162 of sidewall 160 and tapers radially upwardly and outwardly relative to axis X within rectangular interior chamber 151. Wall 198 has a flat guide surface 200 tapering in the same manner. A pair of spaced lateral walls 202 are connected to guide wall 198 and extend radially inwardly therefrom to connect to interior segment 162. Surface 200 and horizontal plane Y define therebetween an angle F which in the exemplary embodiment is approximately 60 degrees. Angle F is the same as angle B (FIG. 11) and falls within the same ranges described with reference to angle B.

Referring back to FIG. 2, bottom wall section 32 includes a generally flat rectangular wall 204, a first tab 206 extending laterally outwardly from one end thereof and a second tab 208 extending upwardly from the opposite end thereof. During assembly, tab 206 is inserted from below into rectangular interior chamber 151 (FIG. 12) and seated atop ledge 170 and tab 208 is pushed upwardly into chamber 151 to form a snap fit connection with ledge 172 so that bottom wall section 32 is non-removably secured to bottom member 30 to bound the bottom of interior chamber 151.

FIG. 14 shows a sectional view of bottle security device 10 when assembled in the unsecured position. Securing members 20 are spread apart far enough so that the inner perimeters 64 thereof have a greater diameter than that of flange 16 of bottle neck 14 so that flange 16 and neck 14 have been inserted upwardly through entrance opening 156 and the opening formed between members 20 into cavity 41 of cap 18 with flange 16 disposed upwardly of upper surfaces of 70 of members 20. EAS tag 34 is disposed within rectangular interior chamber 151. Top member 28 is secured to the top of bottom member 30 typically by ultrasonic welding although another fastening mechanism may be used such as glue, fasteners such as screws and so forth. Prior to the connection of top member 28 to bottom member 30, top wall 36 and side wall 38 of cap 18 are inserted upwardly through entrance opening 122 of top member 28 so that lower end 42 of side wall 38 is disposed in opening 122 and slidably engages circular wall portion 118 during relative rotation. Flange 44 of cap 18 is disposed within circular interior chamber 149 (FIG. 13) with the upper surface of flat annular wall 59 slidably engaging the lower surface of circular wall portion 118 during rotation and the lower crescent shaped surfaces 65 of wall 59 seated on and slidably engaging the upper surfaces 70 of securing members 20 during rotation of cap 18. Outer perimeter 45 of flange 44 is closely adjacent or slidably engages inner surface 161 (FIG. 12) of side wall 160 during rotation of cap 18. Ridges 50 are received within respective grooves 86 of securing members 20, which are also disposed in circular interior chamber 149. Securing members 20 are thus sandwiched between flange 44 and circular bottom wall portion 152 of the housing. A portion of each securing member 20 adjacent inner perimeter 64 is disposed directly below side wall 38 of cap 18 in the unsecured position. Inner perimeters 64 of the securing members 20 lie on a circle of a diameter which is substantially the same as that of opening 156. Tapered guide wall 198 extends upwardly into cavity 146 with its upper end abutting inner surface 144 of interior wall 142 adjacent its connection to front wall 126. Surface 200 of wall 198 is parallel to surface 140 of rear wall 128. Rear and front sides 102 and 104 of locking member 22 respectively slidably engage surfaces 140 and 200 as locking member 22 moves upwardly and downwardly between its unlocked and locked positions. Cylinder 24 is secured to member 22 in lower chamber 108 and spring 26 is disposed in upper chamber 110 abutting ledge 114 (FIG. 8) at its lower end and the inner surface of front wall 126 at its upper end to provide a spring bias on locking member 22 towards its locked position. Lateral sides 106A and B of locking member 22 also slidably engage lateral walls 202 (FIG. 12).

Further details of the assembled structure of device 10 are now described with reference to FIG. 15. FIG. 15 is a sectional view of device 10 with securing members 20 (shaded) in the unsecured position. Ridges 50A-C are shown within the spiraling grooves 86 of the respective securing members 20A-C. Securing members 20 are positioned with outer perimeters 66 abutting inner surface 161 of sidewall 160 and thus lie on a circular path concentric about axis X. Outer ends 54 of ridges 50 are at outer ends 85 of grooves 86 and abut or are closely adjacent inner surface 161 outside of and circumferentially spaced from respective grooves 192. Inner ends 52 of ridges 50 are adjacent respective guides 176 with outer cam surfaces 58 adjacent ends 52 slidably engaging inner surfaces 191 of respective arms 182. Each inner end 52 of a ridge 50 is thus positioned radially inwardly of and adjacent a respective arm 182 and at the same height thereof. The inner ends 52 of respective ridges 50A and 50B are likewise adjacent and spaced radially inwardly of posts 136B and 136A, which are disposed at the first ends 47 of respective slots 46B and 46A in the unsecured position of securing members 20. The inner ends 52 of each of ridges 50 also abuts one of abutment surfaces 74 adjacent a first end 60 of a respective securing member 20. The abutment surface 74 on a second end 62 of an adjacent securing member 20 is parallel to and spaced from the abutment surface 74 contacted by said first end 52. Each lower plate 76 of a respective member 20 is positioned within the channel defined between a pair of parallel guide surfaces 178 and 180 with surfaces 72 on ends 60 and 62 of member 20 slidably engaging surfaces 178 and 180. Tabs 94 are positioned beneath overhangs 184 and surfaces 92 slidably engage surfaces 186 and 188 of a respective pair of adjacent arms 184. The upper surfaces of tabs 94 also respectively are closely adjacent or slidably engage the lower surfaces of overhangs 184, which further substantially eliminate vertical movement of each securing member 20, which thus slides linearly along a horizontal path. Each ridge 174 is received within a groove 80 (FIG. 17) of a respective securing member 20 with surfaces 81 (FIG. 17) of securing member 20 slidably engaging guide surfaces 175 of ridge 174. Bottom surface 68 (FIG. 14) slidably engages the upper surface of circular bottom wall portion 152. The sliding engagement between the various guide surfaces guides the sliding movement of each member 20 radially inwardly from the unsecured position (FIGS. 14-15) to the secured position (FIGS. 16-17) and radially outwardly in reverse. More particularly, each securing member 20 slides in a linear fashion parallel to surfaces 81 and 175 and the radius along which the respective ridge 174 and groove 80 lies.

Figure 16:
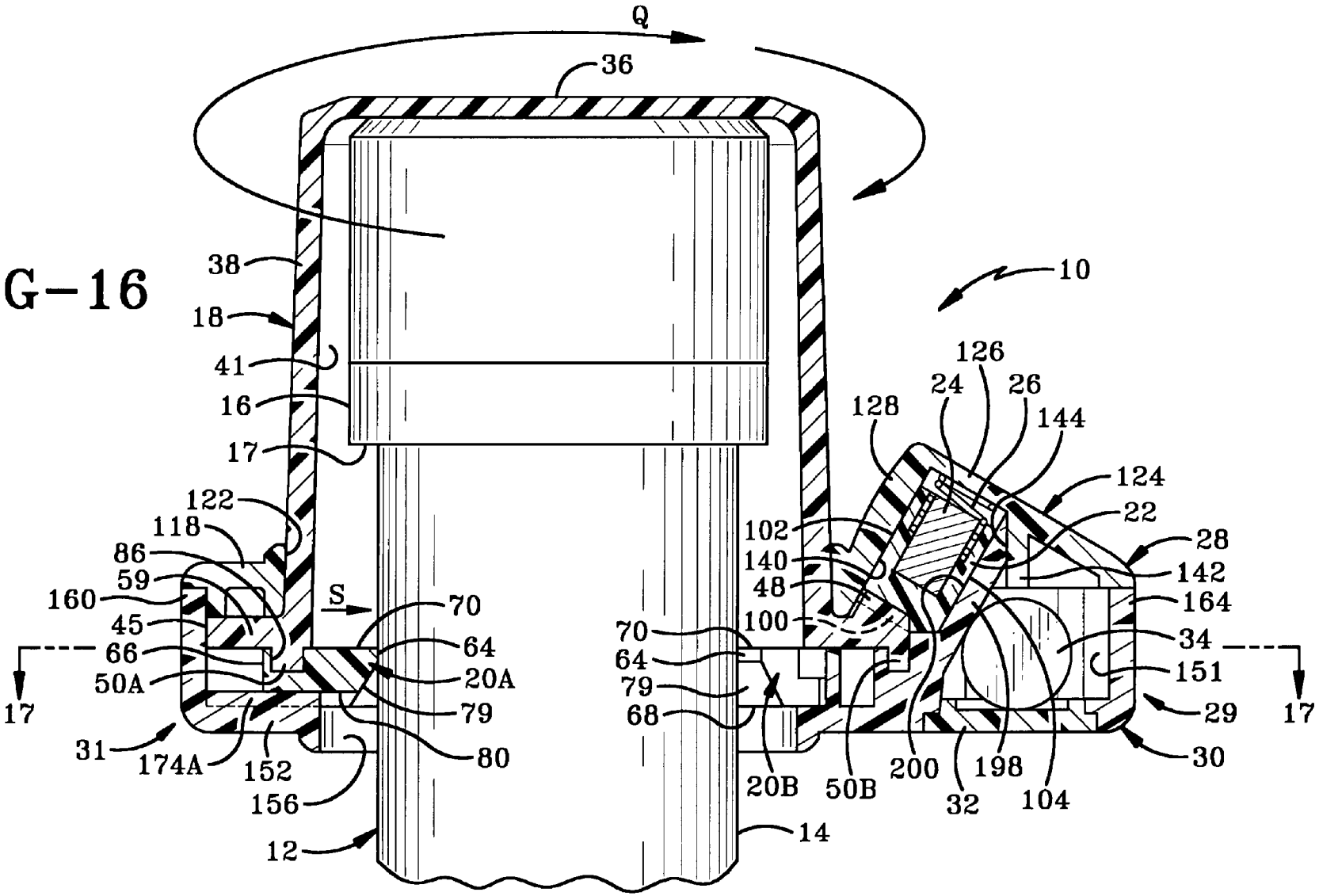
FIG. 16 is similar to FIG. 14 and shows the bottle security device in the secured position.
Figure 18:
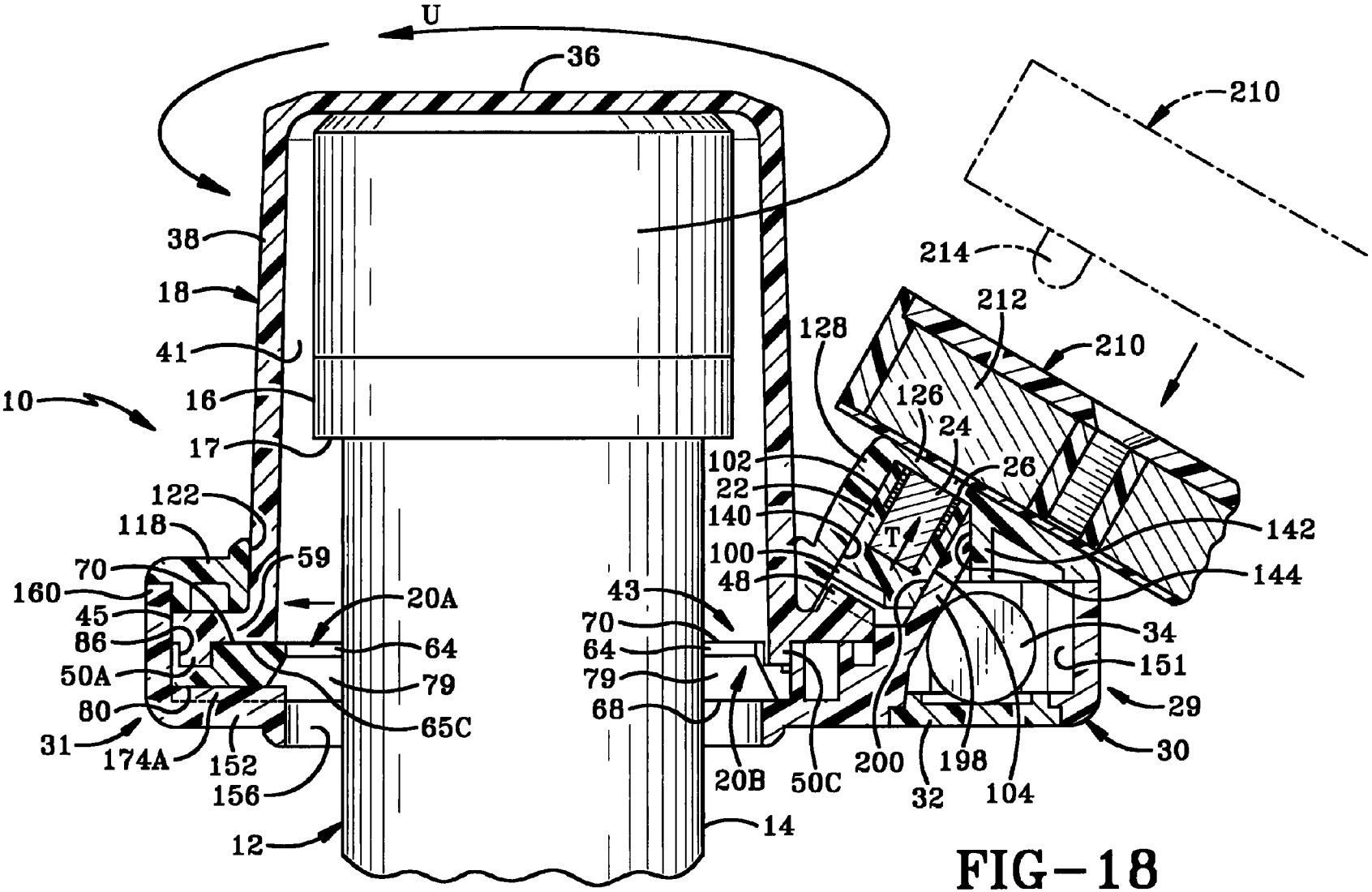
FIG. 18 is a sectional view similar to FIG. 14 showing the key unlocking the locking mechanism, rotation of the cap to move the securing members from the secured to the unsecured position.

The operation of the device 10 is now described with reference to FIGS. 16-18. In order to move securing members 20 to the secured position (FIGS. 16-17), cap 18 is rotated (Arrows Q in FIG. 16) so that ridges 50 rotate (Arrows R in FIG. 17) relative to the housing and the outer ends 54 of ridges 50 slidably engage inner surface 161 of sidewall 160 and move into respective grooves 192 between arms 184 and sidewall 160. Each inner cam surface 56 of a respective ridge 50 adjacent outer end 54 matingly engages outer surface 190 as outer end 54 rotates into slot 192. Each inner end 52 of a respective ridge 50 moves circumferentially within a respective slot 86 away from the abutment surface 74 which it engaged in the unsecured position shown in FIG. 15. The rotational movement of cap 18 causes inner cam surfaces 56 of ridges 50 to respectively slidably engage inner cam surfaces 88 of securing members 20 to force members 20 to slide linearly radially inwardly (arrows S) to the secured position of FIGS. 16 and 17 from the unsecured position of FIGS. 14 and 15. When securing members 20 move radially inwardly as far as they are able, the abutment surfaces 74 of adjacent securing members 20 abut one another and portions of inner perimeters 64 of securing members 20 move to a position beneath flange 16 of bottle neck 14 and radially inwardly of the outer surface of flange 16 so that device 10 cannot be removed from bottle neck 14. More particularly, an attempt at such a removal will cause upper surfaces 70 of securing member 20 to abut lower surface 17 of flange 16 to prevent the removal. Inner perimeters 64 adjacent their midpoints are closely adjacent or abut the outer surface of bottle neck 12. In the secured position, inner perimeters 64 form a generally triangular shape having sides which are arcs instead of straight lines. During the rotation of cap 18, the position of posts 136 A and B respectively shift to the second ends 49 of respective slots 46A and 46B. Outer ends 54 of ridges 50A and 50C are respectively adjacent and spaced radially outwardly of posts 136 and second ends 49 of slots 46. The rotational movement of cap 18 to move members 20 from the unsecured position to the secured position may be accomplished without unlocking locking member 22 due to the one-way nature of locking teeth 100 and 48. After rotation to the secured position, locking member 22 is biased by spring 26 to the locked position with teeth 100 thereof lockably engaging teeth 48 on flange 44 of cap 18, as shown in FIG. 16.

To move securing members 20 from the secured position to the unsecured position, a key member 210 (FIG. 18) including a magnet 212 is first used to unlock device 10. Key member 210 includes an alignment tab 214 which is receivable within key alignment notch 134 (FIGS. 2, 9) on wedge shaped section 124 to align magnet 212 with magnetically attractable cylinder 24 in order to attract cylinder 24 toward the magnet 212. Cylinder 24 is secured to locking member 22 so that locking member 22 is likewise moved (Arrow T) toward magnet 212 to overcome the spring bias of spring 26 so that locking teeth 100 are disengaged from locking teeth 48, thus allowing cap 18 to rotate in a direction (Arrow U ) opposite that shown in FIG. 16 (Arrows Q). Rotation in this opposite direction causes outer ends 54 of ridges 50 to move circumferentially along a circular path out of grooves 192 with outer cam surfaces 58 slidably engaging outer cam surfaces 90 of members 20 to force members 20 to move radially outwardly in a linear fashion from the secured position of FIGS. 16 and 17 to the unsecured position of FIGS. 14 and 15. Inner perimeters 64 of securing member 20 thus move outwardly beyond the outer surface of flange 16 so that bottle neck 14 may be removed from within cavity 41 of cap 18.

It is noted that while locking member 22 is spring biased to the locked position, securing members 20 are not spring biased to the unsecured position. This prevents securing members 20 from automatically moving to the unsecured position if locking member 22 is moved even momentarily to its unlocked position. The housing of device 10 is also configured to make it more difficult for locking member 22 to become dislodged from its locking position in an attempt to defeat device 10. In some bottle security devices, locking members which are magnetically attractable move in a horizontal direction radially outwardly from a locked position to an unlocked position. Unfortunately, thieves have been known to swing the bottle and device perpendicular to an axis analogous to axis X to hit the side of the bottle security device housing of such devices on a hard surface in order to cause such locking members to overcome the spring bias to move the locking member to its unlocked position. When this occurs, if a securing member is spring biased to its unsecured position, it will rapidly move to the unsecured position upon even the momentary release of the locking member so that the security device may be easily removed from the bottle neck. The housing and locking member of the present invention are configured to help reduce the ability to defeat the locking mechanism. Thus, although the securing members may be spring biased to their unsecured position, in the exemplary embodiment the securing members do not automatically move to the unsecured position when the locking member is in the unlocked position. In addition, locking member 22 moves to the unlocked position not in a radially outwardly horizontal direction (perpendicular to axis X) but rather radially upwardly and outwardly in a linear fashion (Arrow T) at an angle to the horizontal. While this angle may vary, it is shown in the exemplary embodiment to move at an angle of approximately 60 degrees relative to the horizontal, being guided by guide surfaces 140 and 200 which are so angled. The angle at which locking member 22 moves is thus the same as angle B (FIG. 11) and falls within the ranges noted with respect thereto. Thus, even though an impact on front wall 126 of wedge shaped portion 124 of the housing may be able to overcome the spring bias of spring 26 to move locking member 22 to the unlocked position, this movement is more difficult to achieve than that of the prior art devices discussed above. This is true because a horizontal or vertical force is most easily applied to device 10 and the angled movement of locking member 22 and its engagement with surrounding structure reduces the effect of such force in causing locking member 22 to overcome the spring bias of spring 26.

Figure 19:
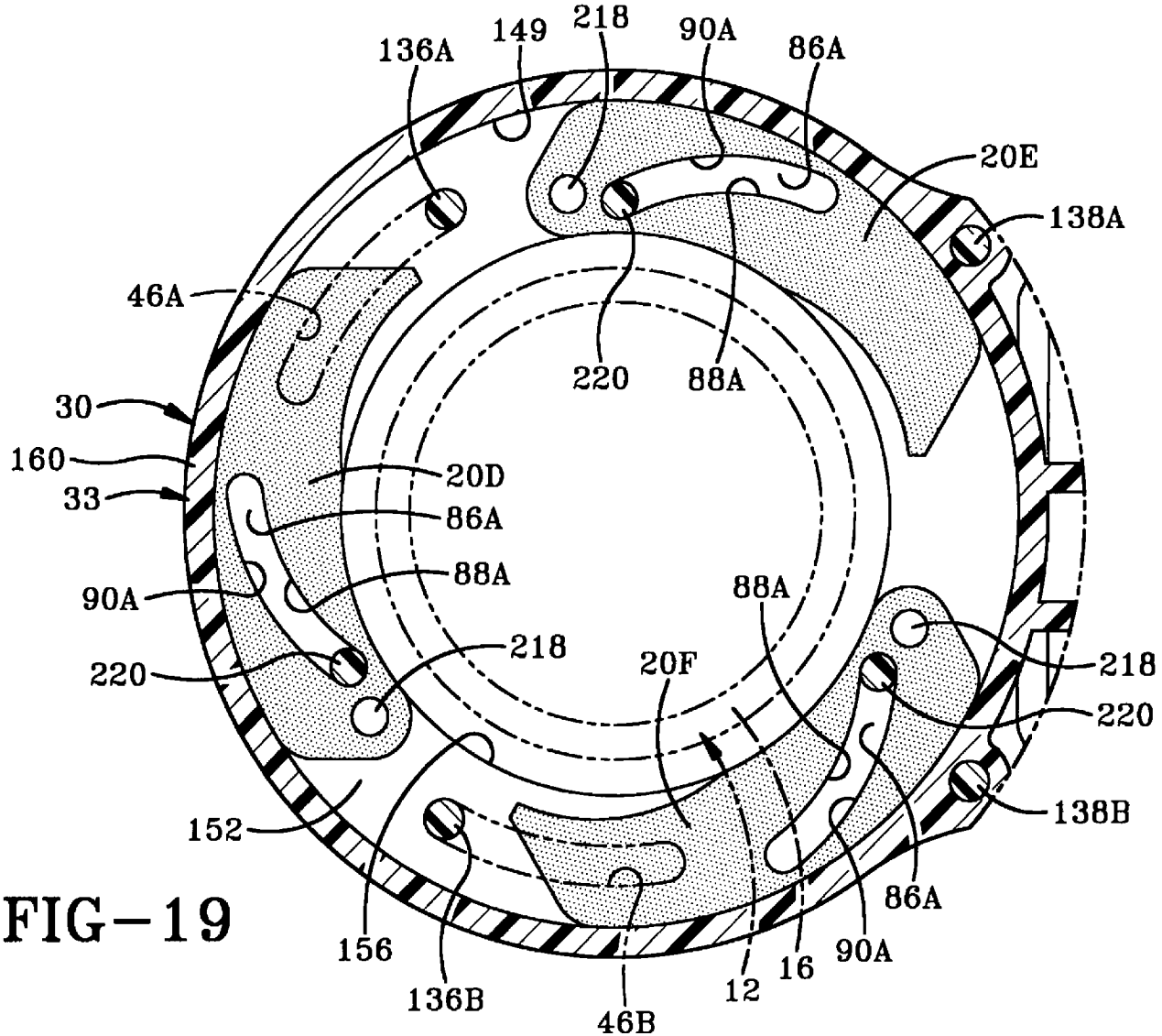
FIG. 19 is a sectional view similar to FIG. 15 illustrating an alternate set of pivotable securing members in the unsecured position.
Figure 20:
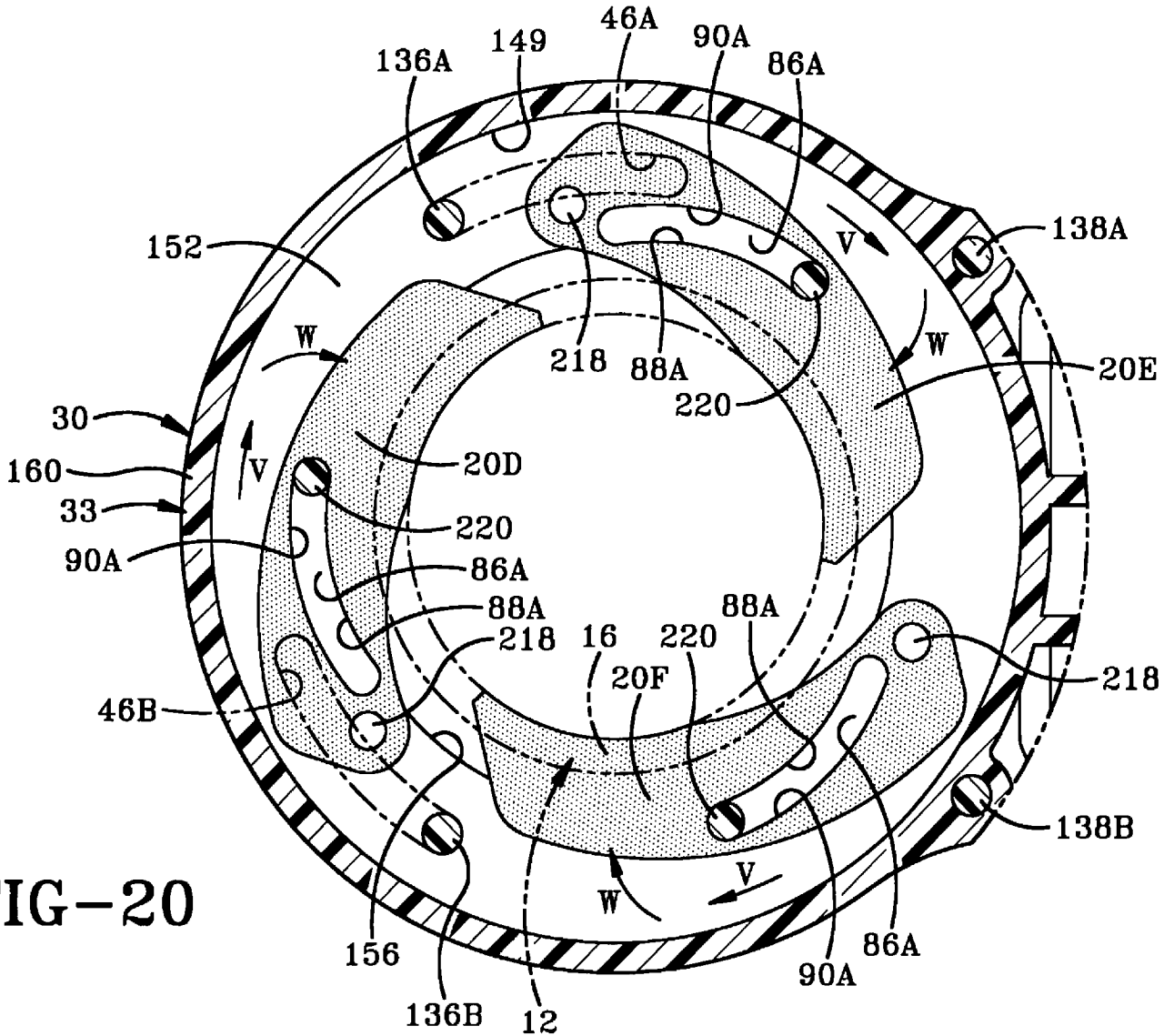
FIG. 20 is similar to FIG. 19 and shows the securing members pivoted to the secured position.

FIGS. 19 and 20 show an alternate embodiment of pivotable securing members 20D-F. Securing members 20D-F are respectively pivotally mounted on pivots 218 which are secured to circular bottom wall portion 152 and extend into interior chamber 149. A groove or slot 86A is formed in each of securing members 20D-F and spirals radially outwardly in the same manner as grooves 86 formed in securing members 20A-C. Each of securing members 20D-F thus includes cam surfaces 88A and 90A which spiral outwardly in the same manner as cam surfaces 88 and 90 of securing members 20A-C. However, instead of using spiraling ridges such as ridges 50, cam projections shown as generally cylindrical pins 220 are received respectively in each of slots 86A for camming engagement with the respective cam surfaces 88A and 90A. Pins 220 thus are connected to and project downwardly from annular flange 44 of cap 18 instead of ridges 50.

In operation, camming pins 220 rotate along with cap 18 as indicated by Arrows V in FIG. 20 to slidably engage respective cam surfaces 88A to force the respective securing members 20D-F pivotally inward about pivots 218 as indicated at Arrows W from the unsecured position of FIG. 19 to the secured position of FIG. 20. As with the previous embodiment, securing members 20D-F in the unsecured position of FIG. 19 are spaced radially outwardly of the outer circumference of flange 16 of bottle neck 14 and pivot inwardly beneath flange 16 radially inward of its outer circumference in the secured position of FIG. 20 in order to prevent removal of the bottle securing device from the bottle neck. Rotation of pins 220 along with cap 18 in the opposite direction of Arrows V causes pins 220 to slidably engage cam surfaces 90A to pivot securing members D-F in the opposite direction from the secured position in FIG. 20 to the unsecured position of FIG. 19.

Thus, bottle security device 10 provides several advantageous features and new structures within the art which are configured to prevent the theft of bottle 12 or the contents thereof without the use of a special key member or without breaking bottle 12 or damaging device 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A bottle security device comprising:

a housing;

an interior chamber formed in the housing;

a cap rotatable relative to the housing about a vertical axis;

a portion of the cap in the interior chamber;

a cavity formed in the cap adapted to receive therein a portion of a bottle neck;

at least one securing member in the interior chamber;

a first cam surface which spirals radially outwardly relative to the axis;

a second cam surface;

a sliding engagement between the first and second cam surfaces during rotation of the cap relative to the housing;

a secured position of the at least one securing member adapted to engage the bottle neck;

an unsecured position of the at least one securing member adapted to be disengaged from the bottle neck; and wherein the at least one securing member is movable in response to the sliding engagement from one of the secured and unsecured positions to the other of the secured and unsecured positions; and a lock adapted to lock the at least one securing member into the secured position so that the bottle security device cannot be removed from the bottle neck, and wherein the lock is adapted to be unlocked with a key so that the at least one security member can be moved to the unsecured position.

2. The device of claim 1 wherein the first cam surface extends a circumferential distance of at least thirty degrees.

3. The device of claim 1 further comprising first and second circumferentially opposed ends on the at least one securing member; and wherein the first cam surface extends from adjacent the first end toward the second end.

4. The device of claim 3 wherein the first cam surface extends from adjacent the first end to adjacent the second end.

5. The device of claim 1 wherein the at least one securing member is pivotable between the secured and unsecured positions.

6. The device of claim 1 wherein the second cam surface spirals radially outwardly relative to the axis and forms a mating engagement with the first cam surface.

7. The device of claim 1 further comprising a projection in the interior chamber; and a groove which spirals radially outwardly relative to the axis and receives therein the projection; and wherein one of the projection and groove is on the at least one securing member; the other of the projection and groove is on one of the cap and housing; and the first cam surface is one of on the projection and bounding the groove.

8. The device of claim 7 wherein the projection is a ridge which spirals radially outwardly relative to the axis.

9. The device of claim 1 further comprising an annular flange on the cap in the interior chamber; and wherein the first cam surface is on the flange.

10. The device of claim 1 further comprising an annular flange on the cap in the interior chamber; a slot formed through the flange; and a post on the housing extending through the slot.

11. The device of claim 1 further comprising a sliding engagement between the at least one securing member and the cap during rotation of the cap relative to the housing.

12. The device of claim 1 further comprising an annular sidewall on the housing; and wherein the at least one securing member contacts the sidewall in the unsecured position and is out of contact with the sidewall in the secured position.

13. The device of claim 1 wherein the at least one securing member comprises a plurality of securing members which contact one another in the secured position and are out of contact with one another in the unsecured position.

14. The device of claim 1 further comprising inner perimeters respectively on the at least one securing member forming respective arcs.

15. The device of claim 1 further comprising a pair of guide surfaces in the interior chamber; and wherein the at least one securing member slidably engages the guide surfaces to guide movement of the at least one securing member between the secured and unsecured positions.

16. The device of claim 1 further comprising first and second guide surfaces extending transversely to one another in the interior chamber; and wherein the at least one securing member comprises first and second securing members which respectively slidably engage the first and second guide surfaces to guide movement of the first and second securing members between the secured and unsecured positions.

17. The device of claim 16 further comprising an upwardly-facing surface on the housing; first and second overhangs respectively adjacent and extending outwardly beyond the first and second guide surfaces; a portion of the first securing member extending under and adjacent the first overhang; and a portion of the second securing member extending under and adjacent the second overhang; and wherein the first and second securing members slidably engage the upwardly-facing surface.

18. The device of claim 1 further comprising first and second opposed ends on the at least one securing member; and first and second overhangs on the housing extending respectively over the first and second ends of the at least one securing member.

19. The device of claim 1 wherein the lock is in the housing; a locked position of the lock which prevents rotation of the cap relative to the housing in a first direction; an unlocked position of the lock which allows rotation of the cap relative to the housing in the first direction; a spring member which biases the lock to the locked position; and a guide surface within the housing for guiding movement of the lock; and wherein the lock slidably engages the guide surface to move linearly between the locked and unlocked positions at an angle relative to horizontal ranging from 20 to 70 degrees.

20. A bottle security device comprising:

a housing;

an interior chamber formed in the housing;

a cap rotatable relative to the housing about a vertical axis;

a portion of the cap in the interior chamber;

a cavity formed in the cap adapted to receive therein a portion of a bottle neck;

at least one securing member in the interior chamber;

a first cam surface which spirals radially outwardly relative to the axis;

a second cam surface;

a sliding engagement between the first and second cam surfaces during rotation of the cap relative to the housing;

wherein one of the first and second cam surfaces is on the at least one securing member;

the other of the first and second cam surfaces is on one of the cap and housing; and the at least one securing member is movable in response to rotation of the cap relative to the housing between a secured position adapted to engage the bottle neck and an unsecured position adapted to be disengaged from the bottle neck.

* * * * *